US006673744B1

(12) United States Patent
Taguchi et al.

(10) Patent No.: US 6,673,744 B1
(45) Date of Patent: Jan. 6, 2004

(54) THERMAL TRANSFER RECORDING IMAGE RECEIVING LAYER AND THERMAL TRANSFER RECORDING IMAGE RECEIVER

(75) Inventors: Nobuyoshi Taguchi, Ikoma (JP); Shigeru Yoshida, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/806,926

(22) PCT Filed: Oct. 7, 1999

(86) PCT No.: PCT/JP99/05552

§ 371 (c)(1),
(2), (4) Date: Apr. 6, 2001

(87) PCT Pub. No.: WO00/20224

PCT Pub. Date: Apr. 13, 2000

(30) Foreign Application Priority Data

| | | |
|---|---|---|
| Oct. 8, 1998 | (JP) | 10-286249 |
| Nov. 10, 1998 | (JP) | 10-318728 |
| Sep. 22, 1999 | (JP) | 11-268617 |

(51) Int. Cl.[7] ..... B41M 5/035; B41M 5/38

(52) U.S. Cl. ..... 503/227; 156/235; 156/384; 428/32.39; 428/32.51

(58) Field of Search ..... 8/471; 428/195, 428/32.39, 32.51; 503/227; 156/235, 384

(56) References Cited

U.S. PATENT DOCUMENTS

| | | | | |
|---|---|---|---|---|
| 5,310,719 A | | 5/1994 | Wehrmann et al. | 503/227 |
| 5,344,808 A | * | 9/1994 | Watanabe et al. | 503/227 |
| 5,448,282 A | | 9/1995 | Imai et al. | 347/213 |

FOREIGN PATENT DOCUMENTS

| | | |
|---|---|---|
| EP | 0 133 011 | 2/1985 |
| EP | 0 266 430 | 5/1988 |
| EP | 0 513 757 | 11/1992 |
| EP | 0 709 230 | 5/1996 |
| JP | 59-225994 | 12/1984 |
| JP | 60-25793 | 2/1985 |
| JP | 61-199997 | 9/1986 |
| JP | 61-283595 | 12/1986 |
| JP | 62-238791 | 10/1987 |
| JP | 64-42285 | 2/1989 |
| JP | 4-113893 | 4/1992 |
| JP | 5-4459 | 1/1993 |
| JP | 5-96867 | 4/1993 |
| JP | 5-131764 | 5/1993 |
| JP | 6-143831 | 5/1994 |
| JP | 6-166272 | 6/1994 |
| JP | 8-118822 | 5/1996 |
| JP | 8-118823 | 5/1996 |
| JP | 2670539 B2 | 7/1997 |
| WO | 90/01419 | 2/1990 |

* cited by examiner

*Primary Examiner*—B. Hamilton Hess
(74) *Attorney, Agent, or Firm*—Wenderoth, Lind & Ponack, L.L.P.

(57) ABSTRACT

An object of the present invention is to provide an image receiving layer (3) which alliveates or substantially dissolves at least one problem selected from a low quality of the image such as glossiness and sharpness, a low preservative property of the image such as heat resistance, and a high running cost. Moreover, an object of the present invention is to provide a thermal transfer recording image receiver (1) having such image receiving layer (3). To achieve the objects, the present invention provides a image receiving layer (3) for a thermal transfer recording image receiver (1) having a substrate (2) and the image receiving layer (3) characterized in that the image receiving layer (3) is formed from a composition comprising an acrylic polyol resin and other thermoplastic resin. Further, the present invention provides such thermal transfer recording receiver (1) having the image receiving layer as well as a thermal transfer recording method using the receiver.

54 Claims, 5 Drawing Sheets

THERMAL TRANSFER RECORDING IMAGE RECEIVING LAYER AND THERMAL TRANSFER RECORDING IMAGE RECEIVER

TECHNICAL FIELD

The present invention relates to an image receiving layer of an image receiver for thermal transfer recording used for recording in which a high-temperature heating means for short time, for example a thermal head, an optical head such as a laser or an electrode head etc. is used, relates to an image receiver having an image receiving layer for thermal transfer recording, and relates to a thermal transfer recording method in which the image receiver is used. In particular, the present invention relates to an image receiving layer of an image receiver for thermal transfer recording of a sublimation dye transfer type, a melt dye transfer type, and the like, to an image receiver for thermal transfer recording having such image receiving layer, and to a thermal transfer recording method in which such image receiver is used.

BACKGROUND ART

A thermal transfer recording method is compact and excellent in maintainability and reliability, and furthermore is excellent in less electricity, high speed, prevention against tampering, color recording, and recording on plain paper, etc. Such thermal transfer recording method has received much attention as electronization of OA appliances have developed. An ink sheet for the thermal transfer recording method and an image receiver for the thermal transfer recording method (henceforth, referred to as a "thermal transfer recording image receiver") are used in such thermal transfer recording method. The ink sheet generally comprises a substrate made of a plastic film or the like, a dye layer containing a thermally transferable dye on a front surface of the substrate and a heat-resistant sliding layer on a back surface of the substrate which provides a readily travelling property for a heating means. The thermal transfer recording image receiver generally comprises a substrate made of a plastic film or the like, and an image receiving layer placed on a surface of the substrate which receives the dye from the ink sheet. After arranging the thermal transfer recording image receiver on the ink sheet so that it overlaps the dye layer on the front surface of the ink sheet, the heat-resistant sliding layer of the ink sheet is heated with heat energy corresponding to an image information to be recorded by using the heating means, for example a thermal head, an optical head such as a laser, and an electrode head etc. By this heating, the thermally transferable dye contained in the dye layer of the ink sheet is transferred to the image receiving layer of the thermal transfer recording image receiver through its diffusion, so that the thermal transfer recording is carried out.

Among the thermal transfer recording methods, a melt dye transfer type or a sublimation dye transfer type thermal transfer recording method is particularly receiving much attention since quality of an image which is obtained by using such method has been improved beyond the quality of an image of the silver halide conventional photograph. The ink sheet is used in this method which has an ink layer containing a melt type transferable dye or subliming thermally transferable dye as the dye layer on the substrate. Recording is carried out by heating the dye layer with a heating means such as a thermal head to transfer (thermally transfer) the thermally transferable dye, through its thermal diffusion, to the image receiving layer of the thermal transfer recording image receiver which layer is in contact with the dye layer. (Hereinafter, merely "to transfer" means "to move a thermally transferable dye to an image receiving layer by transferring the dye through thermal diffusion".) Color recording is performed by thermally transferring, in sequence, a cyan (C) dye, a magenta (M) dye and a yellow (Y) dye contained into the ink layer to the image receiving layer by using the thermal recording head. An amount of the thermally transferable dye to be transferred can be controlled by varying the heat energy to be applied to the dye layer. Therefore, the melt dye transfer type or sublimation dye transfer type thermal transfer recording method is particularly preferable for full-color recording since a gradient recording can easily be carried out.

However, the thermal transfer recording method of the melt dye transfer type or sublimation dye transfer type has a problem in that it produces an image which is inferior to that of the silver halide conventional photography, for example, in an image grade (quality) such as glossiness and sharpness (clearness) of the image, and in an image shelf life such as heat resistance of the image. Moreover, there is a problem in that such thermal transfer recording method requires a higher running cost in comparison with the silver halide conventional photography. These problems would be caused by the thermal transfer recording image receiver rather than the ink sheet. In particular, the image receiving layer of the thermal transfer recording image receiver would relate to the image grade and the image shelf life, etc.

Japanese Patent Kokai Publication No. 60-25793 discloses an image receiving layer for such a thermal transfer recording image receiver. In this image receiving layer, since a plurality of resins which constitute the image receiving layer are incompatible with each other as shown in FIG. 8, the image receiving layer 3 becomes heterogeneous, and the plurality of the resins is phase-separated from each other. In FIG. 8, the image receiving layer 3 is formed on a surface of a substrate 2 of the thermal transfer recording image receiver 1 and the image receiving layer 3 is constituted of two kinds of incompatible regions 31 and 32. As the image receiving layer having such constitution, an image receiving layer is disclosed wherein a resin constituting the image receiving layer is composed of at least two kinds of thermoplastic resins, one of which has a glass transition temperature (Tg) of not higher than 20° C., the other of which has a Tg of not lower than 40° C., and regions of these two kinds of thermoplastic resins having the different Tg's are present together. The thermally transferable dye which is originated from the dye layer of the ink sheet while corresponding to applied thermal recording signals passes mainly through the region of the resin having the lower Tg or interfaces between the regions of the two kinds of the resins to diffuse into the image receiving layer, so that the image is recorded in the image receiving layer.

Since the conventional image receiving layer as described above is lacking in the glossiness and the heat resistance etc., the glossiness and sharpness etc., of the image to be obtained are deteriorated, and it is difficult to obtain an image having a high grade. Moreover, since there is the region of the resin having the lower Tg, it is difficult to obtain an image having a good image shelf life such as a satisfactory heat resistance. Furthermore, since the two kinds of the resins are incompatible, a material to be applied from which the image receiving layer is formed is likely to be subjected to phase separation, and it is difficult to efficiently form the image receiving layer with desired phase separation. This contributes to the cost increase when the thermal transfer recording method is used.

Further, Japanese Patent Kokai Publication No. 61-283595 discloses a saturated polyester and a vinyl chloride-vinyl acetate copolymer as the resins to be used for such image receiving layer, and an amount of moieties derived from vinyl chloride in the vinyl chloride-vinyl acetate copolymer (which corresponds to a percentage of vinyl chloride in monomers when the vinyl chloride-vinyl acetate copolymer is obtained by polymerizing a monomer mixture) is from 85 to 97% by weight in the copolymer. Japanese Patent Kokai Publication No. 61-199997 discloses that a polyester resin, an isocyanate compound, and a silicone compound being capable of reacting with an isocyanate group are used for the image receiving layer. However, when the resin disclosed in the former document is used, there arise problems concerning heat resistance and stability of the image upon high-speed recording. The resin disclosed in the latter document has problems concerning an image grade such as glossiness and sharpness.

DISCLOSURE OF INVENTION

The present invention has completed in order to solve those problems. An object of the present invention is to provide a novel image receiving layer which alleviates or substantially solves at least one of the problems that an image grade (quality) such as glossiness and sharpness etc., of the image to be formed is deteriorated, an image shelf life such as heat resistance of the image is poor, and a running cost is high when the thermal transfer recording method is carried out. Moreover, an object of the present invention is to provide a thermal transfer recording image receiver having such image receiving layer, and also to provide a thermal transfer recording method in which such image receiver is used. In particular, an object of the present invention is to provide an image receiving layer to be used for a sublimation dye transfer type or melt dye transfer type thermal transfer recording, a thermal transfer recording image receiver having such image receiving layer, and a thermal transfer recording method in which such image receiver is used.

In an aspect of the present invention, a novel image receiving layer for the thermal transfer recording image receiver is provided, which layer is an image receiving layer (B) to be used for the thermal transfer recording image receiver comprising a sheet substrate (A) and the image receiving layer (B) placed on one of main surfaces of the substrate, and which layer is characterized in that it is formed from a composition comprising an acrylic polyol resin and the other thermoplastic resin. In another aspect of the present invention, a thermal transfer recording image receiver is provided in which such image receiving layer is used. In a further aspect of the present invention, a thermal transfer recording method is provided which uses such image receiver. Since the image receiving layer is formed from the composition comprising the acrylic polyol resin and the other thermoplastic, the image receiving layer of which strength and dye receiving property, and/or sharpness and so on of an image to be formed are improved can be provided.

DETAILED DESCRIPTION OF THE INVENTION

Figure 1:
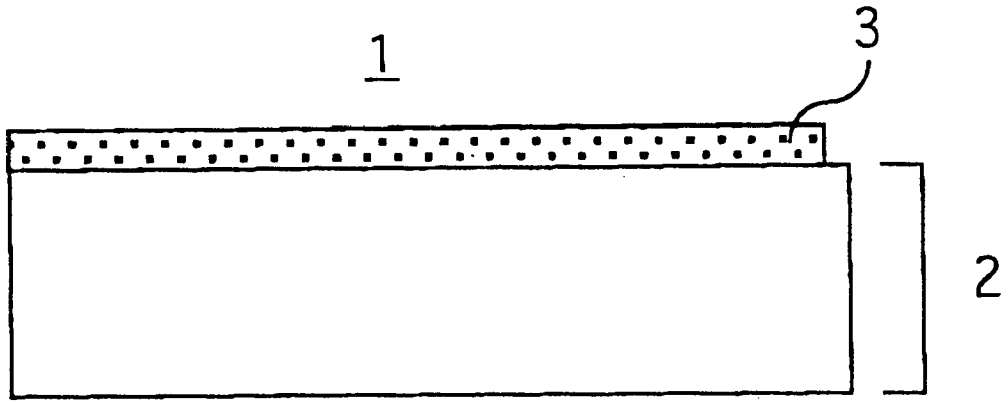
FIG. 1 is a cross-sectional view of a thermal transfer recording image receiver of one embodiment of the present invention.

The present invention is directed to the image receiving layer (B) formed from the composition comprising the acrylic polyol resin (or acrylpolyol resin) and the other thermoplastic resin, to the thermal transfer recording (or printing) image receiver having the image receiving layer, and to the thermal transfer recording (or printing) method in which the image receiving-medium is used.

First, the image receiving layer (B) of the present invention will be described.

The image receiving layer of the present invention is formed from the composition comprising the acrylic polyol resin and the other thermoplastic resin. Moreover, the image receiving layer of the present invention is preferably formed from a composition comprising the acrylic polyol resin and a plurality of the other thermoplastic resins. Additionally, a crosslinking agent and various additives may be added to the composition to form the image receiving layer. The image receiving layer of the present invention is preferably formed from a composition comprising the acrylic polyol resin, a plurality of the other thermoplastic resins, and the crosslinking agent. A material to be applied (or coated) from which the image receiving layer is formed is prepared using the above mentioned composition and a solvent for solving the composition. The material to be applied is preferably uniform as a whole. Moreover, it is preferable that the acrylic polyol resin and the other thermoplastic resin to form the image receiving layer are infinitely compatible and capable of being homogeneous as a whole.

In the present invention, the acrylic polyol resin is used as the resin to form the image receiving layer. In general, an acrylic resin (including a methacrylic resin and a resin prepared by copolymerization of an acrylic monomer and a methacrylic monomer) which is excellent in transparency has not received an attention as a resin to form the image receiving layer which is used for the thermal transfer recording. It seems that this is because the acrylic resin is poor in the dye receiving property that is an important characteristic which the resin to form the image receiving layer is required to have. However, the present inventors have found that the acrylic polyol resin, which is an acrylic resin having a hydroxyl group, has an improved dye receiving property corresponding to an amount of the hydroxyl group contained. The present inventors, therefore, have selected the acrylic polyol resin as the resin which, while maintaining film strength of the image receiving layer, forms an image receiving layer of which transparency is excellent and of which dye receiving property is improved.

The "polyol" of the "acrylic polyol resin" is a generic name for a polymer having two or more hydroxyl groups (—OH) in one molecule and known examples of such polymers include a polyetherpolyol resin and a polyesterpolyol resin, etc., in addition to the acrylic polyol resin.

In the present invention, the "acrylic polyol resin" is a so-called acrylic resin having two or more hydroxyl groups in one molecule. An example thereof is an acrylic resin which is prepared by copolymerization of a (meth)acrylic monomer having a hydroxyl group with a (meth)acrylic ester. The acrylic polyol resin herein preferably has a hydroxyl value of not less than 30, more preferably in the range from 30 to 150, further more preferably in the range from 40 to 90, and particularly preferably about 50. Its glass transition temperature (Tg) is preferably in the range from 40 to 70° C., and more preferably in the range from 50 to 60° C.

Such acrylic polyol resin can be produced using the known methods, but a commercially available resin may be used as the acrylic polyol resin. Specific examples of the acrylic polyol resin include Acrydic A-801 (trade name) and 46-315 (trade name) manufactured by DAINIPPON INK AND CHEMICALS, INC.

The composition to form the image receiving layer preferably contains from 15 to 45% by weight, more preferably from 20 to 40% by weight, and particularly preferably from 25 to 35% by weight of the acrylic polyol resin.

These acrylic polyol resins may be used either alone or in combination of a plurality of the acrylic polyol resins.

In the present invention, the "other thermoplastic resin" refers to a resin which is capable of providing properties such as a dye receiving property and a dye solubility to the acrylic polyol resin and also capable of improving the properties of the image receiving layer by being used in combination with the acrylic polyol resin. Such the "other thermoplastic resin" preferably is at least one selected from a polyester resin, a vinyl chloride-vinyl acetate copolymer resin (henceforth, sometimes referred to as "a vinyl chloride-vinyl acetate resin"), and a silicone resin. In addition, the "other thermoplastic resin" is preferably constituted of two or more kinds of resins selected from the polyester resin, the vinyl chloride-vinyl acetate copolymer resin, and the silicone resin.

The composition to form the image receiving layer preferably contains from 55 to 85% by weight of the other thermoplastic resin, more preferably from 60 to 80% by weight, and particularly preferably from 65 to 75% by weight.

The use of the polyester resin as the "other thermoplastic resin" is preferable because it improves the dye receiving property of the image receiving layer. The "polyester resin" herein may be so-called polyester resin. A low molecular weight polyester resin is preferable as the polyester resin. An upper limit of the number-average molecular weight (Mn) is preferably 15,000, more preferably 10,000, and particularly preferably 6,000. A lower limit of the number-average molecular weight (Mn) is preferably 2,000, more preferably 3,000, and particularly preferably 5,000. A range of the number-average molecular weight (Mn) is preferably from 2,000 to 15,000, more preferably from 3,000 to 10,000, and particularly preferably from 5,000 to 6,000. In addition, the polyester resin is preferably a polyesterpolyol resin, whose hydroxyl value is preferably not less than 30, more preferably from 30 to 200, and particularly preferably from 30 to 70.

Moreover, a polyester resin having a skeleton such as a bisphenol A skeleton in addition to the conventional terephthalic acid skeleton is preferred because it provides the image receiving layer with releasability from a dye layer during the thermal transfer recording (henceforth, referred to as "releasability"). Such polyester resin is preferable because it has enough compatibility with the acrylic polyol resin and provides a homogenized binary transparent resin layer containing the acrylic polyol resin and the polyester resin, which has a high dye receiving property and a high film strength.

The polyester resin preferably has a hydroxyl value of not less than 30 and the bisphenol A skeleton.

Moreover, the polyester resin preferably has a hydroxyl value of 30, the bisphenol A skeleton, and the number-average molecular weight of not greater than 10,000.

Such polyester resin can be produced using the known methods, however a commercially available resin may be used as the polyester resin. Specific examples of the polyester resin include Plasdic ME-100 (trade name) manufactured by DAINIPPON INK AND CHEMICALS, INC. and Biron 220 (trade name) manufactured by TOYOBO CO., LTD.

In addition, a polycaprolactonediol, which is one of the polyesterpolyol resins, can be used as the polyester resin. A number-average molecular weight (Mn) of the polycaprolactonediol is preferably from 900 to 4,000, more preferably from 1,500 to 3,000, and particularly preferably from 2,000 to 3,000. Also in this case, the polycaprolactonediol has enough compatibility with the acrylic polyol resin and provides a homoginized binary transparent resin layer having a high dye receiving property and a high film strength. The polycaprolactonediol preferably has a hydroxyl value of not less than 30, more preferably from 30 to 200, and particularly preferably from 30 to 70.

Such the polycaprolactonediol can be produced using the known methods, but commercially available resin may be used as the polycaprolactonediol. Specific examples of the polycaprolactonediol include Tonepolymer 0230, 0249, and 0310 (trade names) which are polyesterpolybl resins manufactured by Union Carbide Chemicals & Plastics Technology Corporation.

When the other thermoplastic resin is used in combination of a plurality of the thermoplastic resins, the polyester resin is preferably contained in an amount of from 20 to 50% by weight, more preferably from 25 to 45% by weight, and particularly preferably from 30 to 40% by weight, based on the total weight of the combined plural thermoplastic resins.

In general, a typical (saturated linear) polyester resin (of which number-average molecular weight (Mn) is about 20,000) is preferable in its good dye receiving property. However, since it has high tackiness, its use as the resin to form the image receiving layer sometimes makes the dye layer in an ink sheet liable to adhere to the image receiving layer of the thermal transfer recording image receiver when recording is performed by heating the ink sheet with a heating means such as a heating head. Namely, the releasability between the dye layer and the image receiving layer may be deteriorated. Therefore, a releasability improver must be used in order to improve the releasability. In addition, when the acrylic polyol resin and the typical (saturated linear) polyester resin are used together and compatibility between them is not sufficient, it may be difficult to form a smooth and transparent film.

However, even the above typical (saturated linear) polyester resin (of which number-average molecular weight (Mn): about 20,000) can be used when it has a sufficient compatibility with the acrylic polyol resin, it can form a homogenized binary transparent resin layer with a high dye receiving property and a high film strength, and it has not-too-high tackiness.

These polyester resins may be used either alone or in combination of a plurality of the polyester resins.

The image receiving layer (B) of the present invention is preferably formed from a composition comprising the acrylic polyol resin and the polyester resin as the "other thermoplastic resin".

The image receiving layer (B) of the present invention is preferably formed from a composition comprising the acrylic polyol resin and a plurality of resins including the polyester resin as the "other thermoplastic resin".

The use of the vinyl chloride-vinyl acetate resin as the "other thermoplastic resin" is preferable because it improves the dye receiving property of the image receiving layer and the releasability between the dye layer and the image receiving layer. The "vinyl chloride-vinyl acetate resin" herein may be a so-called vinyl chloride-vinyl acetate resin. An additional monomer may be used in the polymerization of the vinyl chloride-vinyl acetate resin. As such vinyl chloride-vinyl acetate resin, a vinyl chloridevinyl acetate resin having a hydroxyl group at an end of the molecule is preferable. A vinyl chloride-vinyl acetate-vinyl alcohol copolymers are preferable. The vinyl chloride-vinyl acetate resin preferably has a glass transition temperature (Tg) in the range from 60 to 80° C., and more preferably in the range from 65 to 75° C. In order to improve the image stability, a content of moieties derived from vinyl chloride in the vinyl chloride-vinyl acetate resin (a content of vinyl chloride in monomers when the vinyl chloride-vinyl acetate resin is obtained by polymerizing a monomer mixture) is preferably not more than 85% by weight, more preferably from 75 to 85% by weight, and particularly preferably from 80 to 82% by weight. The addition of the vinyl chloride-vinyl acetate resin to a compatible resin system of the acrylic polyol resin and the polyester resin can provide a ternary compatible resin system which has further improved dye receiving property and releasability. In addition, the use of a vinyl chloride-vinyl acetate resin modified with a hydroxyl group is preferable since it can improve the dye receiving property and the releasability of the resin layer to be obtained.

It is preferable that the vinyl chloride-vinyl acetate resin contains not more than 85% by weight of the moieties derived from vinyl chloride in the vinyl chloride-vinyl acetate resin, and is modified with a hydroxyl group at its end.

Such vinyl chloride-vinyl acetate resin can be produced by the known methods, but a commercially available resin may be used as the vinyl chloride-vinyl acetate resin. Specific examples of the vinyl chloride-vinyl acetate resin include VROH, VRGC and VRGF (trade names), which are hydroxyl-modified vinyl chloride-vinyl acetate resins manufactured by Union Carbide Chemicals & Plastics Technology Corporation.

These vinyl chloride-vinyl acetate resins may be used alone or in combination of a plurality of the resins.

When the other thermoplastic resin is used in combination of a plurality of the thermoplastic resins, the vinyl chloride-vinyl acetate resin is preferably contained in an amount of from 20 to 50% by weight, more preferably from 25 to 45% by weight, and particularly preferably from 30 to 40% by weight, based on the total weight of the combined plural thermoplastic resins.

The vinyl chloride-vinyl acetate resin is excellent in the dye receiving property and the releasability between the dye layer and the image receiving layer. However the resin has a problem in the stability of images recorded by dyeing, so that it is difficult to use the vinyl chloride-vinyl acetate resin alone as the resin to form the image receiving layer. Therefore, the resin has conventionally been used as an auxiliary resin to form the image receiving layer.

The image receiving layer (B) of the present invention is preferably formed from a composition comprising the acrylic polyol resin, and the polyester resin and the vinyl chloride-vinyl acetate resin as the "other thermoplastic resin".

The use of a silicone resin as the "other thermoplastic resin" is preferable since it improves the releasability between the dye layer and the image receiving layer. The "silicone resin" may be a so-called silicone resin. As such silicone resin, an alkyd-modified silicone resin and a polyester-modified silicone resin which is modified with phthalic acid or terephthalic acid etc., are preferable since they have much effects on improvement of recording sensitivity and enhancement of stability of the recorded image. An acryl-modified silicone resin is preferable for the improvement of the recording sensitivity and the enhancement of the stability of the recorded image since it has enough compatibility with the acrylic polyol resin. A modified silicone resin having a hydroxyl group or a methoxy group for modification can be added to the silicone resin as a film formability (leveling ability) modifier. The silicone resins are preferable because they can make a soft network in the image receiving layer so as to provide a stable image receiving layer which suffers from less degradation with aging and also they can improve the film formability (leveling ability) of the image receiving layer.

The silicone resin is preferably alkyd-modified, polyester-modified or acryl-modified and the end of the resin is preferably not modified with a hydroxyl group.

Such silicone resin can be produced by the known methods, but a commercially available one may be used as the silicone resin. Specific examples of the silicone resin include TSR180 (trade name) which is the alkyd-modified silicone resin, TSR187 (trade name) which is the polyester-modified silicone resin, and TSR171 (trade name) which is the acryl-modified silicone resin, manufactured by Toshiba Silicone Co., Ltd.

These silicone resins can be used alone or in combination of a plurality of the silicone resins.

When the other thermoplastic resin is used in combination of a plurality of the thermoplastic resin, the silicone resin is preferably contained in an amount of from 3 to 35% by weight, more preferably from 7 to 35% by weight, and particularly preferably from 10 to 20% by weight, based on the total weight of the combined thermoplastic resins.

The image receiving layer (B) of the present invention is preferably formed from a composition comprising the acrylic polyol resin, and the polyester resin, the vinyl chloride-vinyl acetate resin and the silicone resin having a hydroxyl group or a methoxy group as the "other thermoplastic resin".

The image receiving layer (B) of the present invention is preferably formed from a composition comprising the acrylic polyol resin, and the polyester resin, the vinyl chloride-vinyl acetate resin and the silicone resin having a hydroxyl group or a methoxy group as the "other thermoplastic resin", and further, each of these resins preferably has a hydroxyl group.

In addition, the composition comprising the acrylic polyol resin(s) and the other thermoplastic resin(s) can contain a crosslinking agent. The addition of the crosslinking agent to the composition to form the image receiving layer is preferable since it can form a crosslinking structure between the acrylic polyol resin(s) itself(themselves), and if possible (that is, when the other resin(s) contains a hydroxy group), between the acrylic polyol resin and the other thermoplastic resin(s) and/or between the other thermoplastic resin(s) itself(themselves), so that the composition is crosslinked and the heat resistance of the image receiving layer to be formed is improved.

As the "crosslinking agent", a typical polyisocyanate compound (which has two or more isocyanate groups (—NCO) in one molecule) is preferable since the compound can form a transparent and tough image receiving layer. An amount of the polyisocyanate compound is preferably from 1 to 10 parts by weight, and more preferably from 2 to 5 parts by weight, based on 100 parts by weight of the sum of the acrylic polyol resin and the other thermoplastic resin.

Such polyisocyanate compound can be produced by the known methods, but a commercially available one can be used as the polyisocyanate compound. Specific examples of the polyisocyanate compound include Colonate L (trade name) containing tolylenediisocyanate (TDI) as a base, and HL and HX (trade names) excellent in light stability containing hexamethylenediisocyanate (HDI) as a base, manufactured by NIPPON POLYURETHANE INDUSTRY CO., LTD.

These polyisocyanate compounds can be used alone or in combination of a plurality of the polyisocyanate compounds.

The composition to form the image receiving layer preferably contains the crosslinking agent and preferably the polyisocyanate compound in an amount of from 1 to 12% by weight, more preferably from 1 to 7% by weight, and particularly preferably from 2 to 5% by weight.

The image receiving layer (B) of the present invention is preferably formed from a composition comprising the acrylic polyol resin; at least one of the other thermoplastic resins; and the crosslinking agent.

The image receiving layer (B) of the present invention is preferably formed from a composition comprising the acrylic polyol resin; a plurality of the other thermoplastic resins; and the crosslinking agent.

The image receiving layer (B) of the present invention is preferably formed from a composition comprising the acrylic polyol resin; the polyester resin as the "other thermoplastic resin"; and the crosslinking agent.

The image receiving layer (B) of the present invention is preferably formed from a composition comprising the acrylic polyol resin; a plurality of the resins which contain the polyester resin as the "other thermoplastic resin"; and the crosslinking agent.

The image receiving layer (B) of the present invention is preferably formed from a composition comprising the acrylic polyol resin; the polyester resin and the vinyl chloride-vinyl acetate resin as the "other thermoplastic resin"; and the crosslinking agent.

The image receiving layer (B) of the present invention is preferably formed from a composition comprising the acrylic polyol resin; the polyester resin, the vinyl chloride-vinyl acetate resin, and the silicone resin having a hydroxy group or a methoxy group as the "other thermoplastic resin"; and the crosslinking agent.

The image receiving layer (B) of the present invention is preferably formed from a composition comprising the acrylic polyol resin; the polyester resin, the vinyl chloride-vinyl acetate resin, and the silicone resin having a hydroxy group or a methoxy group as the "other thermoplastic resin"; and the crosslinking agent, in which composition each of the resins preferably contains a hydroxy group.

In addition, when the requirement for the heat resistance of the image receiving layer is not so strict, the composition without a crosslinking agent can be used effectively.

Moreover, the compositions to form the image receiving layer which contains the acrylic polyol resin and the other thermoplastic resin can contain various kinds of additives which are conventionally included in the image receiving layer in order to make the image receiving layer possess desired properties. Examples of such additives include a resin-compatibility-dispersion accelerator, a releasing agent, an ultraviolet absorber and a light stabilizer, etc.

The "resin-compatibility-dispersion accelerator" means an agent for improving the compatibility of the acrylic polyol resin with the other thermoplastic resin(s). The "releasing agent" means an agent which is capable of providing the image receiving layer with the releasability. Examples of the resin-compatibility-dispersion accelerator and/or the releasing agent include a higher fatty acid ester and a silicone oil modified with a higher fatty acid, etc. As the higher fatty acid ester, for example an alcohol ester of a higher fatty acid such as butyl stearate and an alcohol ester of a polybasic acid having a hydroxyl group can be used. Specific examples thereof include Exepal BS and MS and Vinysizer 20 and 30 (trade names) manufactured by Kao Corporation. As the higher fatty acid-modified silicone oil, a silicone oil whose both ends are modified with a higher fatty acid, and specifically TSF410 manufactured by Toshiba Silicone Co., Ltd., etc. can be exemplified. Both of the higher fatty acid ester and the higher fatty acid-modified silicone oil can exhibit the similar effects in trace amounts. In particular, they are well compatible with the above-mentioned polyester resin and can be used effectively.

These resin-compatibility-dispersion accelerators and the releasing agents can be used alone or in combination of a plurality of them.

A benzotriazole-based ultraviolet absorber and a benzophenone-based absorber etc. can be exemplified as the "ultraviolet absorber". The benzotriazole-based ultraviolet absorber is more preferable. Specific examples of such ultraviolet absorber include Lightace UV-750, 730, 710 and 760 (trade names) manufactured by Sakai Chemical Industry Co., Ltd.

The image receiving layer (B) of the present invention can be used as an image receiving layer for any thermal transfer recording image receiver which is conventionally used. The present invention, therefore, provides a thermal transfer recording image receiver having the abovedescribed image receiving layer.

The thermal transfer recording image receiver can be produced by forming the image receiving layer of the present invention in the thermal transfer recording image receiver using a method similar to known one. For example, the thermal transfer recording image receiver can be produced by adding a solvent capable of solving the above composition for forming the image receiving layer to the composition in order to prepare a material to be applied (or coated), applying the material onto a front surface of a substrate (A) which is conventionally used for the thermal transfer recording image receiver, and then drying the applied material to form the image receiving layer of the present invention. As the "solvent", toluene, methyl ethyl ketone, tetrahydrofuran (THF), methyl isobutyl ketone (MIBK), xylene, ethyl acetate, ethyl cellulose, and dimethylformamide (DMF), etc. are exemplified. As the application method of the material, an application method is exemplified in which the material is applied onto the surface of the substrate while using a roll coater, a microgravure coater, a maysaver, or a gravure coater, etc. Furthermore, air-drying, hot air-drying, and vacuum drying, etc. are exemplified as the drying method. When the crosslinking agent is added to the composition in order to improve the heat resistance of the image receiving layer, the crosslinking structure of the composition is formed mainly during drying.

A releasing layer (C) may further be formed between the substrate (A) and the image receiving layer (B). In addition, a back layer may be formed on the back surface of the substrate. The releasing layer (C) and the back layer can be formed using a method similar to known one.

The substrate (A) of the thermal transfer recording image receiver is one to form a base of the thermal transfer recording image receiver in the form of a film and to support the image receiving layer (B) formed on the front surface of the substrate. There is no particular limitation on the substrate (A) so long as it possesses mechanical strength, elasticity, heat resistance, solvent resistance, sliding ability, and adhesive property, etc., which the base is required to have. The substrate (A) may be in a sheet form or in a continuous (or elongated) form.

Examples of such substrate include:

thin paper such as pulp paper, condenser paper and glassine paper;

a plastic film such as a polyester film, a polycarbonate film, a polyamide film and a polyimide film; and a substrate prepared by laminating pulp paper etc., with a plastic film.

In particular, a substrate made by laminating pulp paper etc., with a polyester film on both surfaces of the paper or the polyester film substrate is preferred.

The substrate can be produced by known methods, and a commercially available one can be used.

The size of the substrate can be adequately selected corresponding to a thermal transfer recording apparatus in which the thermal transfer recording image receiver is practically used.

The "front surface" of the substrate means a surface with which the thermal transfer recording image receiver faces the ink sheet or a surface over which the ink sheet is superposed, and further means a surface on which recording is carried out using the thermal transfer recording.

The thermal transfer recording image receiver wherein the image receiving layer (B) of the present invention is used can be used as a thermal transfer recording image receiver for the thermal transfer recording method which is conventionally employed. The present invention, therefore, provides a thermal transfer recording method using the thermal transfer recording image receiver having the above described image receiving layer (B). As such thermal transfer recording method, the following methods are exemplified: (a) a method in which a back surface of an ink sheet is heated by a heating means so as to transfer a thermally transferable dye from a dye layer of the ink sheet to the image receiving layer of the thermal transfer recording image receiver, so that an image is formed on the image receiving layer (henceforth, also referred to as an "ordinary thermal transfer recording method"); (b) a method in which a back surface of an ink sheet is heated by a heating means so as to transfer a thermally transferable dye from a dye layer of the ink sheet to the image receiving layer of the thermal transfer recording image receiver, so that an image is formed on the image receiving layer, and then the image receiving layer on which the image has been formed is transferred to another substrate (namely, a method for performing thermal transfer recording by re-transferring a thermally transferable dye, which is henceforth also referred to as the "first thermal transfer recording method of a re-transferring type"); and (c) a method in which an image receiving layer of the thermal transfer recording image receiver is once moved to another substrate (a temporary support for the image receiving layer), a back surface of the ink sheet is then heated by a heating means so as to transfer a thermally transferable dye from a dye layer of the ink sheet to the image receiving layer, which has been moved to the temporary support for the image receiving layer so as to form an image on the image receiving layer, and thereafter the image receiving layer, on which the image has been formed, is moved to a further (final) substrate (the method is also a method for performing thermal transfer recording by re-transferring a thermally transferable dye, and the method is henceforth also referred to as the "second thermal transfer recording method of a re-transferring type"). in the present specification, "re-transferring" means the image receiving layer on which an image has been formed is moved to other substrate. The re-transferring type thermal transfer recording methods (b) and (c) will be further explained in detail below.

In addition the thermal transfer recording methods can be carried out using a known apparatus. The present invention provides such thermal transfer recording apparatus.

EMBODIMENTS OF THE INVENTION

The thermal transfer recording image receiver using the image receiving layer according to the present invention, and the thermal transfer recording method using the thermal transfer recording image receiver will be explained below with reference to the accompanying drawings.

FIG. 1 shows a cross-sectional view of a thermal transfer recording image receiver of an embodiment of the present invention. The thermal transfer recording image receiver 1 is composed of a substrate 2 for the thermal transfer recording image receiver and the image receiving layer 3 of the present invention formed on the surface of the substrate. The image receiving layer 3 may or may not be released from the substrate 2. When the image receiving layer 3 is releasable from the substrate 2, it can be preferably used in the first and the second thermal transfer recording methods of the image receiving layer moving type which-will be described later.

Figure 2:
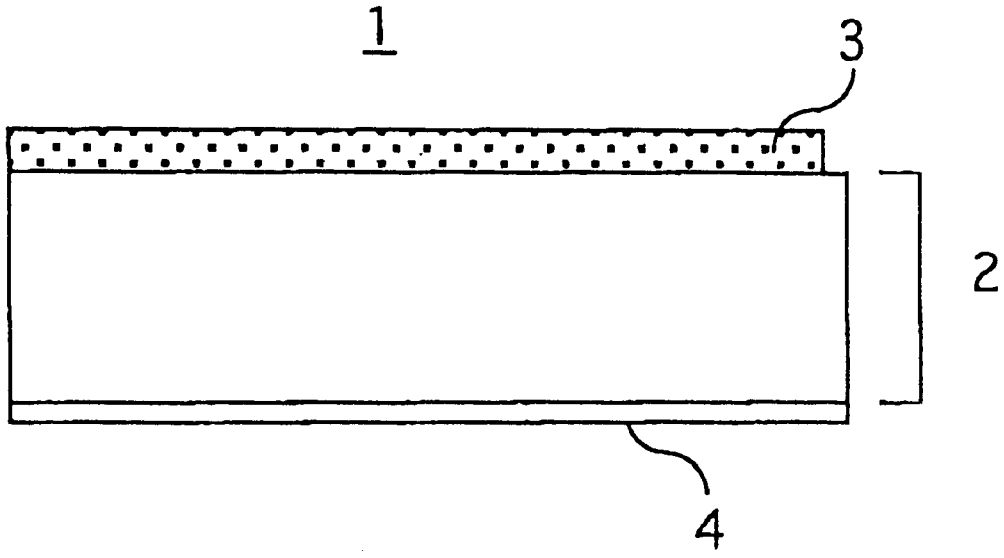
FIG. 2 is a cross-sectional view of a thermal transfer recording image receiver of another embodiment of the present invention.

FIG. 2 shows a cross-sectional view of a thermal transfer recording image receiver of another embodiment of the present invention. A layer 4 on the back side of the substrate 2 (back layer) is provided for the thermal transfer recording image receiver 1 depicted in FIG. 1 to be the thermal transfer recording image receiver 1 shown in FIG. 2. The back layer 4 is provided as required in order to enhance the mechanical strength, the elasticity, the heat resistance, the solvent resistance, the sliding ability, the convey-ability, and the write-ability, etc. of the substrate 2 as desired whereby improving the overall performance. A variety of layers can be used as the back layer 4 depending on the purpose of the back layer. For example, a running-stability-providing layer and a heat-resistant sliding layer can be exemplified.

The "running-stability-providing layer" is provided in order to improve the running stability of the thermal transfer recording image receiver 1 in the thermal transfer recording apparatus by controlling the coefficient of friction of the thermal transfer recording image receiver 1. The "heat-resistant sliding layer" is provided in order to avoid the deformation of the substrate 2 which is caused by heat applied with the heating means such as a heating head in contact with the back surface of the substrate, and in order to smoothen the running of the heating means by simultaneously controlling both the heat resistance and the coefficient of friction of the substrate 2. As the back layer 4, a single layer or a combination of a plurality of the layers can be used.

Figure 3:
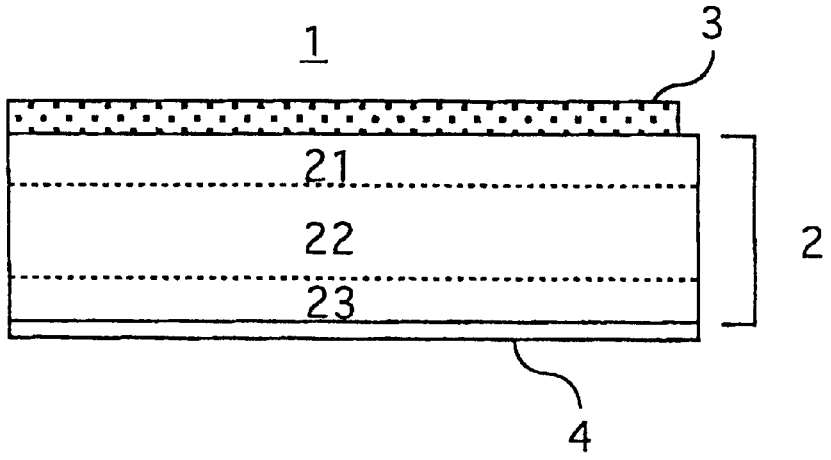
FIG. 3 is a cross-sectional view of a thermal transfer recording image receiver of another embodiment of the present invention.

FIG. 3 shows a cross-sectional view of a thermal transfer recording image receiver of another embodiment of the present invention. The thermal transfer recording image receiver 1 of FIG. 3 comprises the thermal transfer recording image receiver 1 depicted in FIG. 2, of which substrate 2 is composed of a plurality of the layers as required in order to enhance the mechanical strength, the elasticity, the heat resistance, the solvent resistance, the sliding ability, the convey-ability, the write-ability, and the heat insulation property, etc. of the substrate 2 up to their desired levels, whereby improving the overall performance of the substrate. FIG. 3 shows an embodiment in which three layers 21, 22 and 23 are provided as the substrate 2. A specific example of such substrate 2 is a substrate in which both the upper and lower surfaces of pulp paper 22 are laminated with expanded polystyrene layer 21 and 23. The thickness of the substrate 2 of the thermal transfer recording image receiver 1 of the embodiment shown in FIG. 3 is generally from 100 to 200 $\mu$m.

Figure 4:
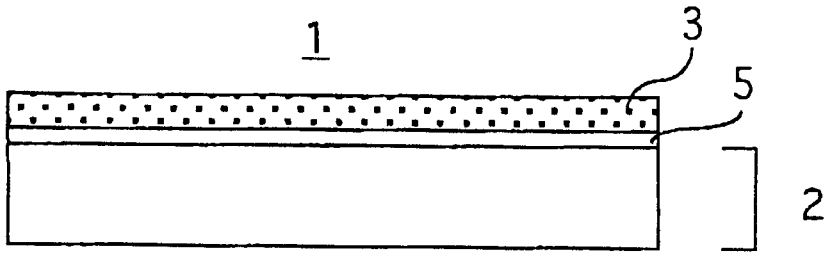
FIG. 4 is a cross-sectional view of a thermal transfer recording image receiver of a further embodiment of the present invention.

FIG. 4 shows a cross-sectional view of a thermal transfer recording image receiver of a further embodiment of the present invention. The thermal transfer recording image receiver 1 shown in FIG. 4 has a releasing layer 5 (C) between the image receiving layer 3 and the substrate 2. The releasing layer 5 is provided for the purpose of releasing the image receiving layer 3 from the image receiver 1 in a desired form by controlling a force required for the image receiving layer 3 to be released from the thermal transfer recording image receiver. In order to practically release the image receiving layer 3, an additional operation such as heating the substrate 2 of the thermal transfer recording image receiver from its back side using a heating means may be carried out while the thermal transfer recording image receiver 1 is in contact with other substrate which will receive the image receiving layer 3 to be released.

In this case, it is contemplated that the image receiving layer 3 is released in the following manner. Tackiness is generated in the image receiving layer 3 which is heated, so that an adhesive force (F1) between the image receiving layer 3 and said other substrate which is in contact therewith increases. When the force (F1) is larger than an adhesive force (F2) between the image receiving layer 3 and the releasing layer 5 and the force (F1) is smaller than a cohesive force of the image receiving layer 3 itself, the image receiving layer 3 is released from the releasing layer 5 and transfers to said other substrate with which the image receiving layer 3 is in contact. Varying components which constitute the composition to form the releasing layer 5 can control the quantity of the force (F2) upon being released. In addition, the quantity of the force (F2) can also be controlled by adopting a composition grading area across an interface of the both layers from a portion of one layer to a portion of the other layer, in which area a concentration of a specific component common to the releasing layer 5 and the image receiving layer 3 varies continuously or pseudo-continuously.

There is no particular limitation on the composition which forms the releasing layer 5 as long as the releasing layer 5 satisfies its desired properties, however the composition preferably comprises an acrylic polyol resin. The composition to form the releasing layer 5 preferably contains a crosslinking agent since the crosslinked structure is formed in the composition, which improves the heat resistance of the releasing layer. Moreover, the composition to form the releasing layer 5 preferably contains a silicone resin and/or a fluororesin. The composition to form the releasing layer 5 can contain other thermoplastic resin(s), thermosetting resin (s) and additive(s) which are used to form the releasing layer 5. Such material constitution of the composition to form the releasing layer 5 is preferable since the it can also lead to the composition grading area between the releasing layer 5 and the image receiving layer 3 to be formed thereon and the releasing force adequate to the purpose can be achieved. When the composition as described above is used to form the releasing layer 5, the releasing force between the substrate 2 and the image receiving layer 3 can be appropriately adjusted. The image receiving layer 3, therefore, can be released from the image receiver 1 as if to form a mirror-finished surface, so that a high grade image can be obtained which has the excellent glossiness and sharpness, etc.

As the "acrylic polyol resin" and the "crosslinking agent" used for the composition to form the releasing layer 5, for example, the acrylic polyol resin to form the above image receiving layer 3 and the conventional polyisocyanate compound described as the crosslinking agent to form the above image receiving layer 3 can preferably be used. The acrylic polyol resin preferably has a hydroxyl value of not less than 30, more preferably from 30 to 150, further more preferably from 40 to 90, and particularly preferably about 50. When the heat resistance requirement of the releasing layer 5 is not so strict, the composition without the crosslinking agent can be used effectively as the composition to form the releasing layer 5.

The "silicone resin" and/or the "fluororesin" used for the composition to form the releasing layer 5 are not particularly limited as long as the releasing layer 5 exhibits its desired properties. Examples of the silicone resin include modified silicone resins such as an alkyd-modified silicone resin, a polyester-modified silicone resin, an acrylmodified silicone resin, and a hydroxyl group-modified (hydroxyl-modified) silicone resin, etc. Examples of the fluororesin include resins obtained by polymerizing at least one monomer selected from vinylidene fluoride, hexafluoropropylene, and tetrafluoroethylene, etc.

The "other thermoplastic resin(s)", the "thermosetting resin(s)", and the "additive(s)" used in the composition to form the releasing layer 5 (C) may be for example a thermoplastic resin such as a polyester resin, a vinyl chloride-vinyl acetate resin and a phenoxy resin, a thermosetting resin such as an epoxy resin and a phenol resin, and various additives such as a resin-compatibility-dispersion accelerator, a releasing agent and an ultraviolet absorber. As these resins and additives, those used for the composition to form the image receiving layer 3 can be used.

The releasing layer 5 (C) can be formed by using methods similar to those conventionally used to form the releasing layer of the thermal transfer recording image receiver. For example, it can be formed by preparing a material to be applied (or coated) to form the releasing layer 5 therefrom using the composition to form the above releasing layer 5 and a solvent to dissolve the composition, then by applying the material to a front surface of the substrate 2, and then by drying the material.

In the thermal transfer recording image receiver of the present invention, the releasing layer (C) is preferably formed from a composition comprising the acrylic polyol resin.

In the thermal transfer recording image receiver of the present invention, the releasing layer (C) is preferably formed from a composition comprising the acrylic polyol resin and the crosslinking agent.

In the thermal transfer recording image receiver of the present invention, the releasing layer (C) is preferably formed from a composition comprising the acrylic polyol resin, the silicone resin, and the crosslinking agent.

In the thermal transfer recording image receiver of the present invention, the releasing layer (C) is preferably formed from a composition comprising the acrylic polyol resin, the silicone resin having a hydroxy group or a methoxy group, and the crosslinking agent.

Figure 5:
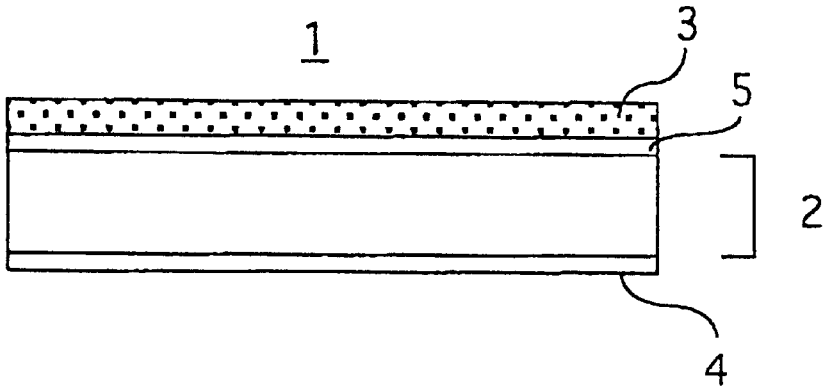
FIG. 5 is a cross-sectional view of a thermal transfer recording image receiver of a further embodiment of the present invention.

In the thermal transfer recording image receiver of the present invention, any of the above releasing layers (C) and any of the above image receiving layers (B) can be used in combination. Examples of such combination are as follows:

The releasing layer (C) is preferably formed from a composition comprising the acrylic polyol resin and the crosslinking agent, and the image receiving layer (B) is preferably formed from a composition comprising the acrylic polyol resin, the polyester resin as the "other thermoplastic resin", and the crosslinking agent;

The releasing layer (C) is preferably formed from a composition comprising the acrylic polyol resin and the crosslinking agent, and the image receiving layer (B) is preferably formed from a composition comprising the acrylic polyol resin, at least one "other thermoplastic resin", and the crosslinking agent;

The releasing layer (C) is preferably formed from a composition comprising the acrylic polyol resin and the crosslinking agent, and the image receiving layer (B) is preferably formed from a composition comprising the acrylic polyol resin, a plurality of the resins including the polyester resin as the "other thermoplastic resin", and the crosslinking agent;

The releasing layer (C) is preferably formed from a composition comprising the acrylic polyol resin, the silicone resin having a hydroxy group or a methoxy group, and the crosslinking agent, and the image receiving layer (B) is preferably formed from a composition comprising the acrylic polyol resin, the polyester resin as the "other thermoplastic resin", and the crosslinking agent;

The releasing layer (C) is preferably formed from a composition comprising the acrylic polyol resin, the silicone resin having a hydroxy group or a methoxy group, and the crosslinking agent, and the image receiving layer (B) is preferably formed from a composition comprising the acrylic polyol resin, at least one "other thermoplastic resin", and the crosslinking agent; and The releasing layer (C) is preferably formed from a composition comprising the acrylic polyol resin, the silicone resin having a hydroxy group or a methoxy group, and the crosslinking agent, and the image receiving layer (B) is preferably formed from a composition comprising the acrylic polyol resin, a plurality of the resins including the polyester resin as the "other thermoplastic resin", and the crosslinking agent FIG. 5 shows a cross-sectional view of a thermal transfer recording image receiver of a further embodiment of the present invention. The thermal transfer recording image receiver 1 shown in FIG. 5 is provided by forming a back layer 4 on the back side of the substrate 2 of the thermal transfer recording image receiver 1 depicted in FIG. 4. As previously explained with reference to FIG. 2, in order to provide the thermal transfer recording image receiver with a desired performance, a variety of layers can be used for the back layer 4 depending on its purpose. A heat-resistant sliding layer is used preferably as the back layer 4, since the operation of heating the back surface of the substrate 2 is conducted by a heating means such as a heating head for releasing the image receiving layer 3 from the releasing layer 5, particularly when the thermal transfer recording method of the re-transferring type is used which method will be explained later.

The "heat-resistant sliding layer" means a layer to protect the substrate from deformation caused by heat of the heating means and to provide sliding ability to the heating means which contacts the heat-resistant sliding layer, so that the abrasion of the heating means and damage of the substrate of the thermal transfer recording image receiver are prevented. In general, the heat-resistant sliding layer can be formed by using a material to constitute a composition which forms the heat-resistant sliding layer provided on the back surface of the ink sheet (see, Japanese Patent No. 2,670,539, and Japanese Patent Kokai Publication No. 59-225994, etc.). The heat-resistant sliding layer can be constituted, for example, from a curable resin such as a thermosetting resin, a light curable resin and a moisture curable resin, a thermoplastic resin, a silicone oil, and a solid lubricant, etc., which are used to constitute the composition to form the heat-resistant sliding layer (henceforth, "to constitute the composition to form the heat-resistant sliding layer" is also referred to as "to form the heat-resistant sliding layer").

As the "thermosetting resin to form the heat-resistant sliding layer", a cured material formed by a reaction of a polyol resin with a polyisocyanate compound etc. can be exemplified. As the "light curable resin to form the heat-resistant sliding layer", a cured material of an epoxyacrylate which is cured by ultraviolet etc. can be mentioned. As the moisture curable resin to form the heat-resistant sliding layer, a cured material obtained via a silane coupling reaction etc. can be mentioned. Specific examples of the moisture curable resin to form the heat-resistant sliding layer include a moisture curable type silicone acrylic resin formed from an amino group-containing silicone acrylic resin (Acrydic BZ-1161 and FZ1032 (trade names) manufactured by DAINIPPON INK AND CHEMICALS, INC.) and a silicone-based curing agent (Acrydic A-9585, BZ-1163 and GZ-354 (trade names) manufactured by DAINIPPON INK AND CHEMICALS, INC.). As the thermosetting resin to form the heat-resistant sliding layer, a composition of an acrylic polyol resin (Acrydic A-801 (trade name) manufactured by DAINIPPON INK AND CHEMICALS, INC.) and an isocyanate compound (Colonate L (trade name) manufactured by NIPPON POLYURETHANE INDUSTRY CO., LTD.) etc. can be mentioned. These curable resins can be used alone or in combination of a plurality of them.

As the "thermoplastic resin", a polyester resin, a phenoxy resin, an acrylonitrile-styrene (AS) resin, and a one component-type epoxy resin, etc., can be mentioned. The acrylonitrile-styrene (AS) resin contains acrylonitrile as a monomer upon the polymerization reaction (that is, the resin contains moieties derived from acrylonitrile) in an amount of preferably from 25 to 35% by weight, and more preferably from 28 to 30% by weight. The AS resin containing from 25 to 35% by weight of the moieties derived from acrylonitrile is preferred since it can improve the adhesive property between the heat-resistant sliding layer and the substrate and can prevent the pollution of a surface of a thermal recording head. Examples of such the AS resin include AS-H (trade name) manufactured by DENKI KAGAKU KOGYO KABUSHIKI KAISHA and Cebian N (080) manufactured by DAICEL CHEMICAL INDUSTRIES, LTD. These thermoplastic resins can be used alone or in combination of a plurality of them.

As the "silicone oil to form the heat-resistant sliding layer" and the "solid lubricant to form the heat-resistant sliding layer", any ones possessing the desired properties can be used with no particular limitation. For example, KF-96 (trade name) manufactured by Shin-Etsu Chemical Co., Ltd. etc. can be mentioned as the silicone oil to form the heat-resistant sliding layer, and talc (for example, 5000PJ (trade name) manufactured by Matsumura Sangyo Co., Ltd.) and silica etc. can be mentioned as the solid lubricant to form the heat-resistant sliding layer. The silicone oils and solid lubricants can be used alone or in combination of a plurality of them.

In general, the heat-resistant sliding layer can be formed using a method similar to that to form the heat-resistant sliding layer of the ink sheet. For example, it can be formed by preparing a material to be applied (or coated) using a composition to form the heat-resistant sliding layer and a solvent to dissolve the composition therein, then by applying the material to the back surface of the substrate, and then by drying the material.

In the thermal transfer recording image receiver of the present invention, the heat-resistant sliding layer is preferably formed from a composition comprising the acrylic polyol resin, at least one thermoplastic resin and the crosslinking agent.

The heat-resistant sliding layer can be combined with any releasing layer (C) and any image receiving layer (B) as described above. The following are exemplified as the combination:

The heat-resistant sliding layer is preferably formed from a composition comprising the acrylic polyol resin, at least one thermoplastic resin and the crosslinking agent, the releasing layer (C) is preferably formed from a composition comprising the acrylic polyol resin and the crosslinking agent, and the image receiving layer (B) is preferably formed from a composition comprising the acrylic polyol resin, the polyester resin as the "other thermoplastic resin" and the crosslinking agent;

The heat-resistant sliding layer is preferably formed from a composition comprising the acrylic polyol resin, at least one thermoplastic resin and the crosslinking agent, the releasing layer (C) is preferably formed from a composition comprising the acrylic polyol resin and the crosslinking agent, and the image receiving layer (B) is preferably formed from a composition comprising the acrylic polyol resin, at least one of the "other thermoplastic resin" and the crosslinking agent;

The heat-resistant sliding layer is preferably formed from a composition comprising the acrylic polyol resin, at least one thermoplastic resin and the crosslinking agent, the releasing layer (C) is preferably formed from a composition comprising the acrylic polyol resin and the crosslinking agent, and the image receiving layer (B) is preferably formed from a composition comprising the acrylic polyol resin, a plurality of the resins including the polyester resin as the "other thermoplastic resin" and the crosslinking agent;

The heat-resistant sliding layer is preferably formed from a composition comprising the acrylic polyol resin, at least one thermoplastic resin and the crosslinking agent, the releasing layer (C) is preferably formed from a composition comprising the acrylic polyol resin, the silicone resin having a hydroxy group or a methoxy group and the crosslinking agent, and the image receiving layer (B) is preferably formed from a composition comprising the acrylic polyol resin, the polyester resin as the "other thermoplastic resin" and the crosslinking agent;

The heat-resistant sliding layer is preferably formed from a composition comprising the acrylic polyol resin, at least one thermoplastic resin and the crosslinking agent, the releasing layer (C) is preferably formed from a composition comprising the acrylic polyol resin, the silicone resin having a hydroxy group or a methoxy group and the crosslinking agent, and the image receiving layer (B) is preferably formed from a composition comprising the acrylic polyol resin, at least one of the "other thermoplastic resin" and the crosslinking agent; and The heat-resistant sliding layer is preferably formed from a composition comprising the acrylic polyol resin, at least one thermoplastic resin and the crosslinking agent, the releasing layer (C) is preferably formed from a composition comprising the acrylic polyol resin, the silicone resin having a hydroxy group or a methoxy group and the crosslinking agent, and the image receiving layer (B) is preferably formed from a composition comprising the acrylic polyol resin, a plurality of the resins including the polyester resin as the "other thermoplastic resin" and the crosslinking agent.

The above described thermal transfer recording image receivers of the present invention depicted in FIGS. 1–5 can be preferably used as a image receiver for the general thermal transfer recording methods. That is, using a thermal transfer recording printer of the conventional melt dye transfer type or sublimation dye transfer type and the conventional ink sheet, an image can be recorded on the image receiving layer of the thermal transfer recording image receiver according to the present invention. Thus, the recorded image can be preserved as it is by storing the thermal transfer recording image receiver of the present invention on which the image has been recorded. In such general thermal transfer recording method, the thermal transfer recording image receivers shown in FIGS. 2 and 3 can be particularly preferably used.

Moreover, when the image receiving layer of the thermal transfer recording image receiver according to the present invention is so formed that it can be released from the image receiver, the thermal transfer recording image receiver can be preferably used as an image receiver for the thermal transfer recording method in which the image receiving layer having an image thereon is transferred. The "thermal transfer recording method in which the image receiving layer having an image thereon is transferred" means a thermal transfer recording method in which an image receiving layer having an image thereon is transferred to other substrate in the course of the aforementioned thermal transfer recording (henceforth, referred to as a "thermal transfer recording method of a re-transferring type").

The "thermal transfer recording method of the re-transferring type" includes several methods. The first thermal transfer recording method of the re-transferring type is a method in which an image is recorded on an image receiving layer of a thermal transfer recording image receiver, and then the image receiving layer having the image thereon is transferred to other substrate (a final substrate). The second thermal transfer recording method of the re-transferring type is a method in which an image receiving layer of a thermal transfer recording image receiver, on which layer no image has been recorded yet, is once moved to a temporary support for the image receiving layer, an image is then recorded on this transferred layer, and the image receiving layer having the image thereon is further transferred to other (final) substrate.

Figure 6:
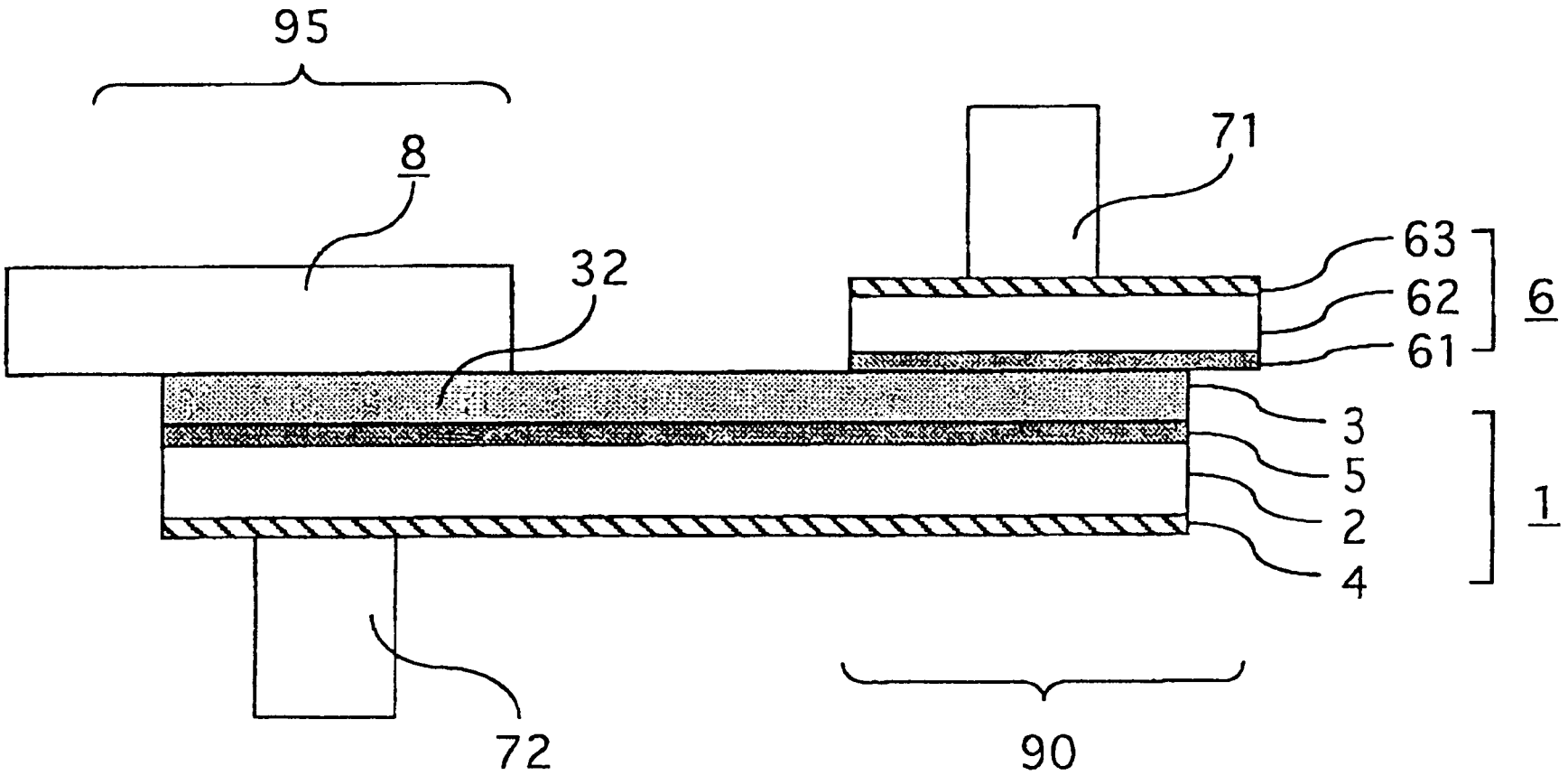
FIG. 6 is a general embodiment for carrying out a first re-transferring type thermal transfer recording method.

The first thermal transfer recording method of the re-transferring type is further explained in detail. FIG. 6 shows a general embodiment of the first thermal transfer recording method of the re-transferring type. In FIG. 6, a thermal transfer recording image receiver 1 has a releasing layer 5 provided on a front surface of a substrate 2, an image receiving layer 3 provided on the releasing layer 5, and a back layer 4 provided on a back surface of the substrate 2. The back layer 4 is preferably a heat-resistant sliding layer which is similar to that usually used for the ink sheet.

First, an image is recorded on the image receiving layer 3 of the thermal transfer recording image receiver 1 in an image recording section 90. An ink sheet 6 and the thermal transfer recording image receiver 1 are nipped between a heating head (an image recording head) 71 and a platen (not shown). The ink sheet 6 is constituted of a dye layer 61 in which an area having a cyan dye, an area having a magenta dye and an area having a yellow dye are formed in thus listed order, a substrate 62 of the ink sheet, and a heat-resistant sliding layer 63 of the ink sheet. The ink sheet 6 is heated by the image recording head 71. The dyes transfer from the dye layer 61 to the image receiving layer 3, so that the image is formed.

Then, the image receiver 1 on which the image has been recorded moves to an image transfer section 95. The image receiving layer 32 on which the image has been recorded and other (final) substrate (paper and a plastic card, etc., are preferable) 8 are nipped between a heating head (an image transfer head) 72 and a platen (not shown). Responding to thermal signals, the thermal transfer recording image receiver 1 is heated by the image transfer head 72, so that the image receiving layer 32 on which the image has been recorded is released from the image receiver 1, and the released image receiving layer 32 is adhered to said other substrate 8, whereby an intended image is formed.

Figure 7:
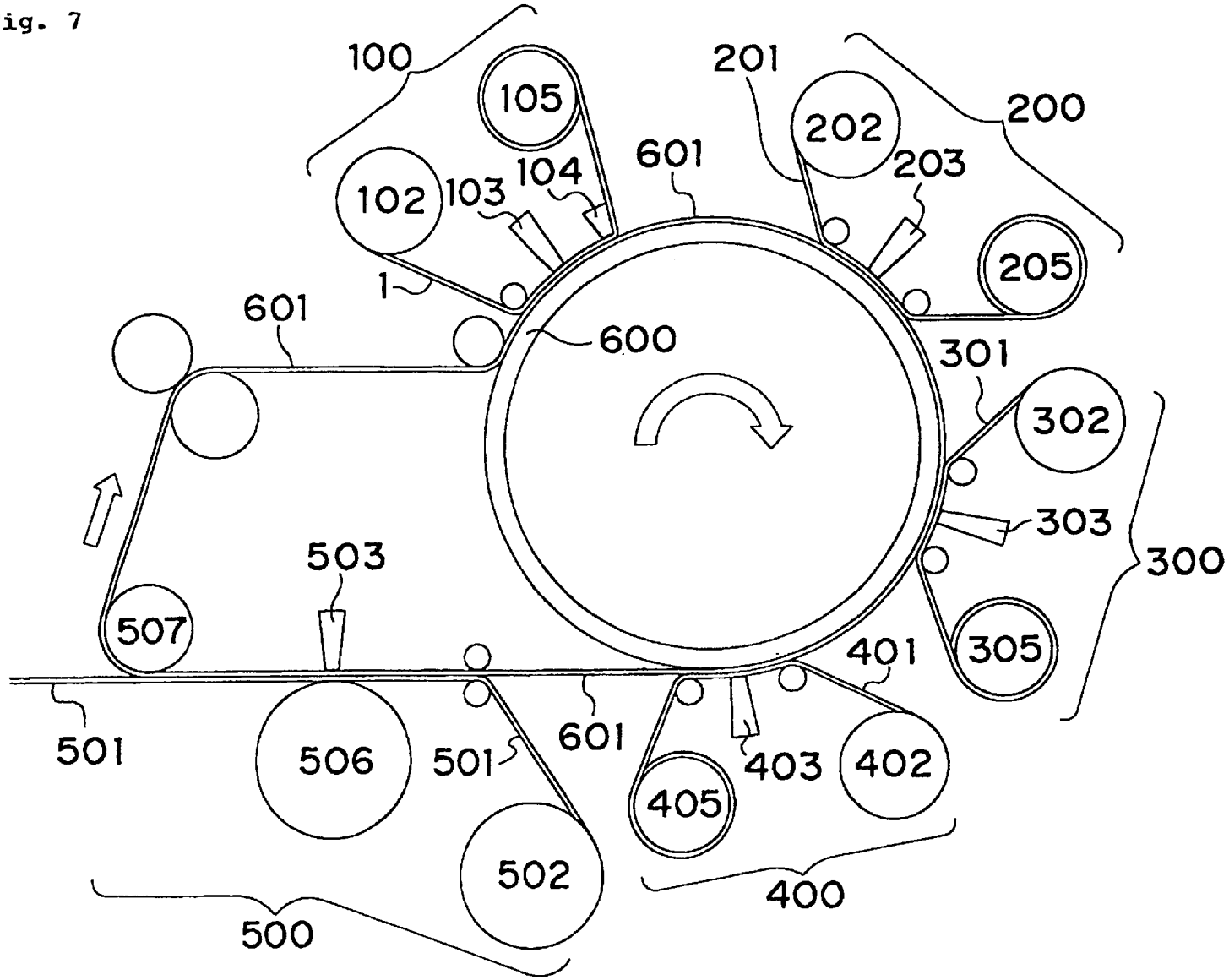
FIG. 7 shows a constitution example of a second re-transferring type thermal transfer recording method.

Next, the second thermal transfer recording method of the re-transferring type is explained further in detail. FIG. 7 shows a constitution example of a recording apparatus using a thermal transfer recording image receiver 1 of which image receiving layer is releasable. Around a larger diameter drum 600, an image receiving layer transfer section 100 and image recording sections 200, 300 and 400 of the three primary colors (Y, M and C) are arranged. An image transfer section 500 is arranged adjacent to the image recording section 400. On the larger diameter drum 800, an temporary support for the image receiving layer 601 is arranged.

In the image receiving layer transfer section 100, the (sheet-like) thermal transfer recording image receiver 1 is drawn from a rewinding section 102 for the image receiver heated by a heating head (an image receiving layer transfer head) 103, so that the image receiving layer 3 is transferred from the image receiver 1 to the temporary support for the image receiving layer 601. This transfer is accelerated by a cold-releasing plate 104, and the image receiving layer 3 is stably formed on the temporary support for the image receiving layer 601. The image receiver 1 from which the image receiving layer 3 has already been released is wound by a winding section 105 for the image receiver.

Then, the image receiving layer which has been transferred to the temporary support for the image receiving layer 601 passes through the image recording sections 200, 300 and 400 corresponding to the rotation of the larger diameter drum 600 and images of Y, M and C are recorded. The numerals 201, 301 and 401 represent a yellow ink sheet, a magenta ink sheet and a cyan ink sheet, respectively. The numerals 202, 302 and 402 denote rewinding sections of the yellow ink sheet, the magenta ink sheet and the cyan ink sheet, respectively. The numerals 203, 303 and 403 indicate heating heads (image recording heads) to record images of Y, M and C, respectively. The ink sheets 201, 301 and 401, are heated by the image recording heads 203, 303 and 403, respectively, so that a thermally transferable dye is transferred from each ink sheet to the image receiving layer 3 to form an image. The numerals 205, 305 and 405 represent winding sections of the yellow ink sheet, the magenta ink sheet and the cyan ink sheet, respectively.

The image receiving layer on which the image has been formed moves to the image transfer section 500, and then is brought in contact with other (final) substrate (preferably, plain paper) 501. The numeral 502 is a rewinding section of the substrate 501. The image receiving layer 3 on which the image has been recorded is heated from a back side of the temporary support for the image receiving layer 601 by a heating head (an image transfer head) 503. Upon thus heating, an image transfer drum 506 is used. The image receiving layer on which the image has been recorded is transferred from the temporary support for the image receiving layer 601 to the final substrate 501. The final substrate 501 onto which the image has transferred is released from the temporary support for the image receiving layer 601 on a releasing drum 607.

The thermal transfer recording method of the re-transferring type is characterized in that the final substrate can be widely selected. The thermal transfer recording method of the re-transferring type is preferable since plain paper can be selected as the final substrate. In addition, the use of the image receiver having the releasing layer can result in clear release at the interface between the image receiving layer and the releasing layer, so that the obtained image can have excellent glossiness. Moreover, the thermal transfer recording image receiver of the embodiment shown in FIG. 5 can be particularly preferably used in the thermal transfer recording method of the re-transferring type.

The present invention, therefore, provides a thermal transfer recording method using any of the aforementioned thermal transfer recording image receivers. As such thermal transfer recording method, the thermal transfer recording method is exemplified in which a back surface of an ink sheet is heated by a heating means to transfer a thermally transferable dye from a dye layer of the ink sheet to the image receiving layer of the thermal transfer recording image receiver, so that an image is formed on the image receiving layer.

In addition, there can be mentioned a method in which a back surface of an ink sheet is heated by a heating means to transfer a thermally transferable dye from a dye layer to the image receiving layer of the thermal transfer recording image receiver, so that an image on the image receiving layer is formed, and then the image receiving layer on which the image has been formed is re-transferred to other substrate.

Moreover, there can also be mentioned a method in which after transferring the image receiving layer of the thermal transfer recording image receiver to the temporary support for the image receiving layer, a back surface of an ink sheet is heated by a heating means to transfer a thermally transferable dye from a dye layer of the ink sheet to the image receiving layer which has been transferred to the temporary support for the image receiving layer, so that an image on the image receiving layer is formed, and then the image receiving layer on which the image has been formed is re-transferred to other substrate.

Furthermore, the present invention provides a thermal transfer recording apparatus which is used for any of the aforementioned thermal transfer recording methods using any of the aforementioned thermal transfer recording image receivers.

EFFECT OF THE INVENTION

The image receiving layer used in the thermal transfer recording image receiver of the present invention has a wide dynamic range in recording density and can form a highly glossy and sharp image thereon. In addition, a surface on which the image is recorded has a glossiness which is substantially equal to that of the silver halide conventional photograph. Upon high-speed recording, no blocking is observed between the image receiving layer of the thermal transfer recording image receiver and the dye layer of the ink sheet, and the image to be obtained has a high concentration. Moreover, the obtained image has a good light resistance.

Furthermore, when the thermal transfer recording image receiver of the present invention in which the image receiving layer is so formed that it is releasable is used in the thermal transfer recording method of the re-transferring type, the surface on which the image has been recorded is transferred and thereby the exposed surface of the image receiving layer is sealed inside. Therefore, at least one image property of the light stability and the finger touch stability can be improved. Furthermore, when the thermal transfer recording image receiver of the present invention in which the image receiving layer is so formed that is releasable is used in the thermal transfer recording method of the re-transferring type, the plain paper can be used as the final substrate. The use of such thermal transfer recording image receiver is advantageous in being inexpensive and putting less load on the global environment.

EXAMPLES

The present invention is further described concretely and in detail by the following Examples and Comparative Examples. However, these Examples are just embodiments of the present invention, and the present invention is not particularly limited by such examples in any way.

Examples 1–3

(1) Production of Thermal Transfer Recording Image Receiver of Example 1

(a) Preparation of Substrate for Thermal Transfer Recording Image Receiver of Example 1

A substrate was prepared by laminating a low density expanded PET having a thickness of 30–60 μm (density d=0.8–1.0, a product of Toray Industries, Inc.) on both sides of a pulpboard having a thickness of 100 μm by using a conventional laminating method.

In addition, water and ethanol as solvents were added to a composition comprising a poly(vinyl alcohol), a cellulose, calcium carbonate, silicon dioxide, and a softening agent, etc. while stirring the composition together with the solvents, and to obtain a homogeneous material to be applied (or coated). The material was applied on the substrate using a meyer bar, and dried for 48 hours at 45° C., and then a running-stability-providing layer having a thickness of 0.3–0.5 μm was formed as a back layer on a back surface of the substrate. A friction coefficient of the running-stability-providing layer was measured using a TENSILON tension testing machine or a HEYDON 14D type testing machine under conditions explained in their directions, and the friction coefficient was 0.2–0.3.

(b) Formation of Image Receiving Layer on Thermal Transfer Recording Image Receiver of Example 1

After mixing and stirring a material to be applied containing the following components, the material was applied on the front surface of the above substrate using a micro gravure coater (#80) to form a coating of thickness of 4–6 μm. Drying the applied material for 96 hours at 45° C. gave an image receiving layer, so that a thermal transfer recording image receiver of Example 1 was obtained. The thermal transfer recording image receiver of Example 1 corresponds to that of the embodiment shown in FIG. 3.

- Acrylic polyol resin . . . 12 parts by weight (Acrydic A-801 (trade name) manufactured by DAINIPPON INK AND CHEMICALS, INC.: It had a hydroxyl value of 50 and a Tg of 50° C.)
- Polyester resin having low molecular weight . . . 14 parts by weight (Plasdic ME-100 (trade name) manufactured by DAINIPPON INK AND CHEMICALS, INC.: It had a hydroxyl value of 40, a bisphenol A skeleton, and a number-average molecular weight of 5,500.)
- Vinyl chloride-vinyl acetate resin . . . 14 parts by weight (VRGF (trade name) manufactured by Union Carbide Chemicals & Plastics Technology Corporation: It was prepared by polymerizing a mixture of monomers containing 81% vinyl chloride by weight (the balance was vinyl acetate etc.).)
- Silicone resin containing hydroxy group . . . 4 parts by weight (TSR-160 (trade name) manufactured by Toshiba Silicone Co., Ltd.: It contained 5% hydroxy group by weight.)
- Higher fatty acid ester . . . 2 parts by weight (Exepal BS (trade name) manufactured by Kao Corporation)
- Toluene and methyl ethyl ketone as solvents . . . 100 parts by weight

(2) Production of Thermal Transfer Recording Image Receiver of Example 2

The thermal transfer recording image receiver of Example 2 was obtained using the same manner as described in the production of the thermal transfer recording image receiver of Example 1, except that the material to be applied to form the image receiving layer in the production of the thermal transfer recording image receiver of Example 1 was replaced by a material to be applied containing the following components. The thermal transfer recording image receiver of Example 2 corresponds to that of the embodiment shown in FIG. 3.

- Acrylic polyol resin . . . 12 parts by weight (Acrydic A-801 (trade name) manufactured by DAINIPPON INK AND CHEMICALS, INC.: It had a hydroxyl value of 50 and a Tg of 50° C.)
- Polyester resin having low molecular weight . . . 14 parts by weight (Plasdic Exp-10T-110 (trade name) manufactured by DAINIPPON INK AND CHEMICALS, INC.: It had a hydroxyl value of 40, a bisphenol A skeleton, and a number-average molecular weight of 5,900.)
- Vinyl chloride-vinyl acetate resin . . . 14 parts by weight (VROH (trade name) manufactured by Union Carbide Chemicals & Plastics Technology Corporation: It was prepared by polymerizing a mixture of monomers comprising 81% vinyl chloride by weight (the residual part was vinyl acetate etc.).)

Silicone resin containing hydroxy group . . . 4 parts by weight (TSR-160 (trade name) manufactured by Toshiba Silicone Co., Ltd.: It contained 5% hydroxy group by 20 weight. )

Higher fatty acid ester . . . 2 parts by weight (Exepal BS (trade name) manufactured by Kao Corporation)

Polyisocyanate compound . . . 1 part by weight (Colonate L (trade name) manufactured by NIPPON POLYURETHANE INDUSTRY CO., LTD.)

Toluene and methyl ethyl ketone as solvents . . . 100 parts by weight (3) Production of thermal transfer recording image receiver of Example 3

The thermal transfer recording image receiver of Example 3 was obtained using the same manner as described in the production of the thermal transfer recording image receiver of Example 1, except that the material to be applied to form the image receiving layer in the production of the thermal transfer recording image receiver of Example 1 was replaced by a material to be applied containing the following components. The thermal transfer recording image receiver of Example 3 corresponds to that of the embodiment shown in FIG. 3.

Acrylic polyol resin . . . 12 parts by weight (Acrydic A-801 (trade name) manufactured by DAINIPPON INK AND CHEMICALS, INC.: It had a hydroxyl value of 50 and a Tg of 50° C.)

Polyester resin having a low molecular weight . . . 14 parts by weight (Plasdic ME-100 (trade name) manufactured by DAINIPPON INK AND CHEMICALS, INC.: It had a hydroxyl value of 40, a bisphenol A skeleton, and a number-average molecular weight of 5,500.)

Vinyl chloride-vinyl acetate resin modified with hydroxy group . . . 14 parts by weight (VRGF (trade name) manufactured by Union Carbide Chemicals & Plastics Technology Corporation: It was prepared by polymerizing a mixture of monomers containing 81% vinyl chloride by weight (the residual part was vinyl acetate etc.). )

Alkyd-modified silicone resin . . . 5 parts by weight (TSR-180 (trade name) manufactured by Toshiba Silicone Co., Ltd.)

Higher fatty acid ester . . . 2 parts by weight (Exepal BS (trade name) manufactured by Kao Corporation)

Higher fatty acid-modified silicone resin . . . 0.1 parts by weight (TSR-410 (trade name) manufactured by Toshiba Silicone Co., Ltd.)

Ultraviolet stabilizer . . . 4 parts by weight (Lightace UV-750 (trade name) manufactured by Sakai Chemical Industry Co., Ltd.: It was a benzophenone type ultraviolet stabilizer.)

Polyisocyanate compound . . . 2 part by weight (Colonate L (trade name) manufactured by NIPPON POLYURETHANE INDUSTRY CO., LTD.)

Toluene and methyl ethyl ketone as solvents . . . 100 parts by weight (4) Evaluations of Thermal Transfer Recording Image Receivers of Examples 1–3

(a) Evaluations Using Commercial Thermal Transfer Printer of Sublimation dye Transfer Type Images were formed on the image receiving layers of the thermal transfer recording image receivers of Examples 1–3 using commercial thermal transfer printers of the sublimation dye transfer type (P-A200 and P-A300 (trade names) manufactured by Matsushita Kotobuki Electronics Industry Co., Ltd.) in combination of the thermal transfer recording image receivers of Examples 1–3 with a commercially available three primary color ink sheet for the thermal transfer printer of the sublimation dye transfer type (Video Print Set VW-MPA50 (trade name) manufactured by Matsushita Electric Industrial Co., Ltd.).

The images formed in the image receiving layers of the thermal transfer recording image receivers of Examples 1–3 had saturated densities of 2.5–2.8 which were determined by using a reflection densitometer (RD 918 (trade name) manufactured by Macbeth Co., Ltd.), wide dynamic ranges, and high glossinesses. In the cases in which the thermal transfer recording image receivers of Examples 1–3 were employed, surface glossiness of the recorded images were 95–100 (positive reflection at 60°) on the basis of a glossiness (100) of the silver halide conventional photograph, and they were substantially the same values as that of the silver halide conventional photograph.

(b) Evaluations Using High Speed Business Printer

Images were formed on the image receiving layers of the thermal transfer recording image receivers of Examples 1–3 by using a high speed business printer, of which printing speed was 5 milli-seconds–10 milli-seconds per line when its printing density was converted based on 150 dpi.

When the images were formed, no blocking, that is, no adhesion by heat between each of the image receiving layers of the thermal transfer recording image receivers of Examples 1–3 and the dye layer of the ink sheet for the high speed business printer, was observed. Moreover, the images obtained had a high glossiness/a high optical density, respectively.

Qualities of the images obtained by using the thermal transfer recording image receivers of Examples 1–3 were superior to those of silver halide conventional photographs formed using signals obtained by photographing the same object with employing an electronics still camera. In the concrete, high density regions of the images obtained using the thermal transfer recording image receivers of Examples 1–3 increased by 15% in comparison with those of the silver halide conventional photographs. Reproductive chromatic regions of the images obtained using the thermal transfer recording image receivers of Examples 1–3 were also superior to those of the images of the silver halide conventional photographs.

(c) Light Resistance of Formed Image

Light resistances of the formed images were measured through a xenon light exposure test. Each of the images formed using the thermal transfer recording image receivers of Examples –3 was exposed to the xenon light at 45° C. for about two weeks. A xenon fade meter FAL-25AX-HC (trade name) manufactured by Suga Test Machine Co., Ltd. was employed. Irradiation energy of the xenon light was 2×108 $J/m^2$. Each chromaticity of the images was measured before and after each image was exposed to the xenon light (a spectrocolorimeter Σ80 (trade name) manufactured by Nippon Denshoku Co., Ltd. was employed as a calorimeter), and difference of the chormaticities between before and after each image was exposed to the xenon light, that is, color difference (ΔE) of each image was determined. Since the color difference is small when ΔE is small, the light resistance of the images is better when ΔE is smaller. The color difference of the image formed using each of the thermal transfer recording image receivers of Examples 1–3 was less than 15.

Comparative Example 1

Figure 8:
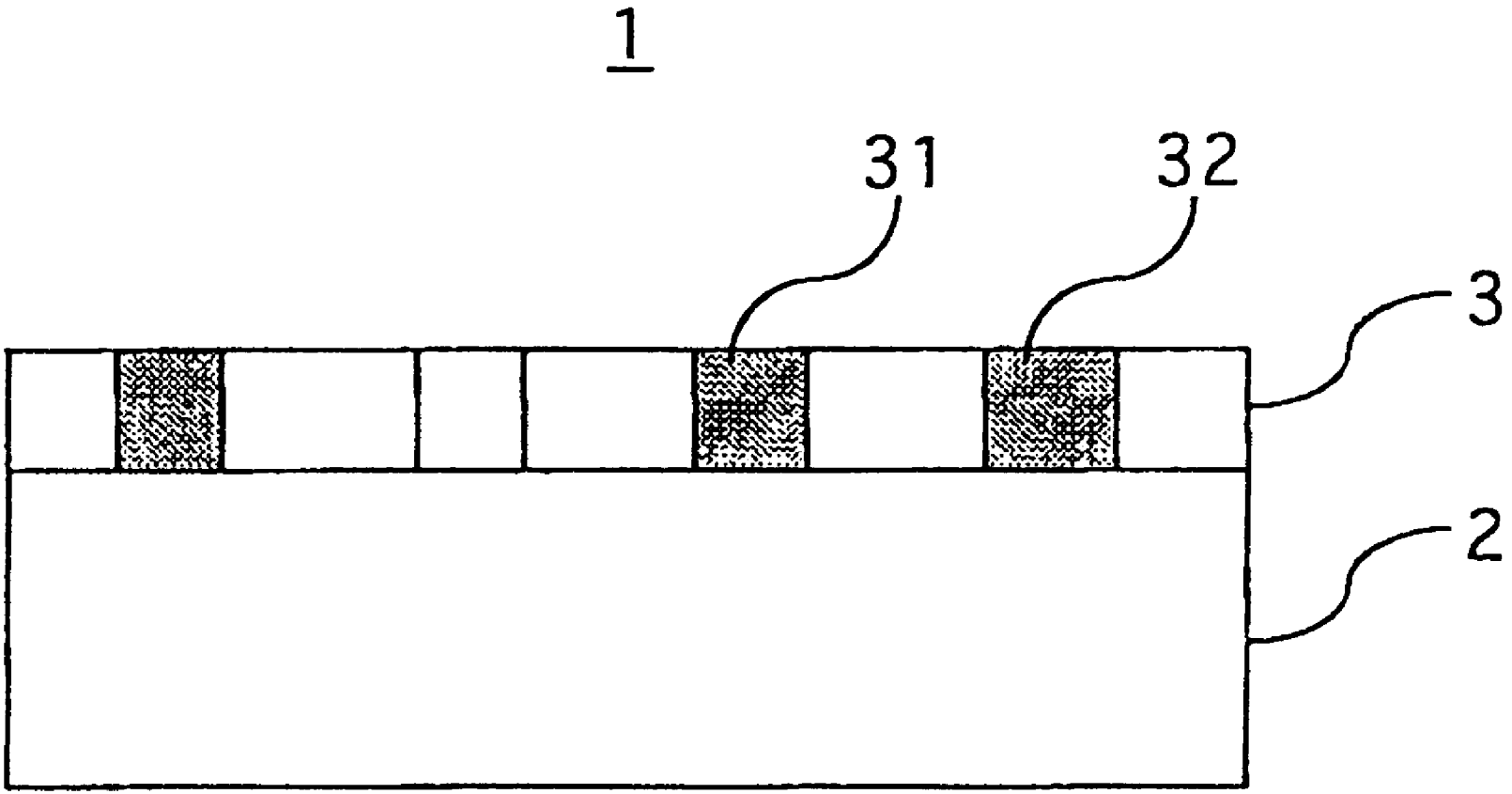
FIG. 8 is a cross-sectional view of the conventional thermal transfer recording image receiver having the image receiving layer in which the phase separation is present.

A commercial thermal transfer recording image receiver (which is a printing sheet mounted in a thermal printer P-A200 (trade name) manufactured by Matsushita Kotobuki Electronics Industry Co., Ltd, and which corresponds to the thermal transfer recording image receiver of the embodiment shown in FIG. 8) was used as a thermal transfer recording image receiver of Comparative Example 1. Evaluation of the thermal transfer recording image receiver of Comparative Example 1 was carried out using the same manner as described in the evaluation of the thermal transfer recording image receivers of Examples –3, except that the thermal transfer recording image receiver of Comparative Example 1 was employed.

When the evaluation of the thermal transfer recording image receiver was carried out by using the commercial thermal transfer printer of the sublimation dye transfer type, no transparent and glossy image was obtained. A surface glossiness of the recorded image was 85 on the basis of the value (100) of the silver halide conventional photograph.

Further, when the evaluation of the thermal transfer recording image receiver was carried out by using the high speed business printer, no highly glossy image was obtained. Qualities of the image obtained using the thermal transfer recording image receiver of Comparative Example 1 were equivalent to or less than those of the silver halide conventional photograph formed using signals obtained by photographing the same object by employing the electronics still camera. A high density region of the image obtained using the thermal transfer recording image receiver was equivalent to that of the silver halide conventional photograph.

Therefore, the qualities of the image obtained using the thermal transfer recording image receiver of Comparative Example 1 was inferior to those of the images obtained using the thermal transfer recording image receivers of Examples 1–3.

In addition, in the light resistance test, the color difference ($\Delta E$) of the image obtained using the thermal transfer recording image receiver of Comparative Example 1 was not less than 30. Thus, the light resistance of the image was low.

Example 4

(1) Production of Thermal Transfer Recording Image Receiver of Example 4

A transparent smooth PET film having a thickness of 16 $\mu$m (a product of Toray Industries, Inc.) was employed as a substrate of the thermal transfer recording image receiver of Example 4.

(a) Preparation of Releasing Layer on Thermal Transfer Recording Image Receiver of Example 4

After mixing and stirring a material to be applied containing the following components, the material was applied to form a coating having a thickness of about 1 $\mu$m on a front surface of the above substrate using a microgravure coater (#100). Drying the applied material for 96 hours at 45° C. gave a releasing layer.

Acrylic polyol resin . . . 85 parts by weight (Acrydic A-801 (trade name) manufactured by DAINIPPON INK AND CHEMICALS, INC.: It had a hydroxyl value of 50 and a Tg of 50° C.)

Silicone resin containing hydroxy group . . . 13 parts by weight (TSR-160 (trade name) manufactured by Toshiba Silicone Co., Ltd.: It contained 5% hydroxy group by weight.)

Higher fatty acid ester . . . 2 parts by weight (Exepal BS (trade name) manufactured by Kao Corporation)

Polyisocyanate compound . . . 35 part by weight (Colonate L (trade name) manufactured by NIPPON POLYURETHANE INDUSTRY CO., LTD.)

Toluene and methyl ethyl ketone as solvents . . . 100 parts by weight (b) Formation of Image Receiving Layer of Thermal Transfer Recording Image Receiver of Example 4

After mixing and stirring a material to be applied containing the following components, the material was applied on the above releasing layer using the micro-gravure coater (#80) to form a coating having a thickness of 4–6 $\mu$m. Drying the applied material for 96 hours at 45° C. gave the image receiving layer.

Acrylic polyol resin . . . 12 parts by weight (Acrydic A-801 (trade name) manufactured by DAINIPPON INK AND CHEMICALS, INC.: It had a hydroxyl value of 50 and a Tg of 50° C.) Polyester resin having a low molecular weight . . . 14 parts by weight (Plasdic ME-100 (trade name) manufactured by DAINIPPON INK AND CHEMICALS, INC.: It had a hydroxyl value of 40, a bisphenol A skeleton, and a number-average molecular weight of 5,500.)

Silicone resin containing hydroxy group . . . 4 parts by weight (TSR-160 (trade name) manufactured by Toshiba Silicone Co., Ltd.: It contained 5% hydroxy group by weight.)

Higher fatty acid ester . . . 2 parts by weight (Vinysizer 30 (trade name) manufactured by Kao Corporation)

Polyisocyanate compound . . . 1 part by weight (Colonate HL (trade name) manufactured by NIPPON POLYURETHANE INDUSTRY CO., LTD.)

Toluene and methyl ethyl ketone as solvents . . . 100 parts by weight (c) Formation of Heat-resistant Sliding Layer of Thermal Transfer Recording Image Receiver of Example 4

After mixing and stirring a material to be applied containing the following components, the material was applied on a back surface of the above substrate using the micro-gravure coater (#100) to form a coating having a thickness of 1 $\mu$m. Drying the applied material for 96 hours at 45° C. gave a heat-resistant sliding layer, and thereby the thermal transfer recording image receiver of Example 4 was obtained. The thermal transfer recording image receiver of Example 4 corresponds to that of the embodiment shown in FIG. 5.

Acrylic polyol resin . . . 60 parts by weight (Acrydic A-801 (trade name) manufactured by DAINIPPON INK AND CHEMICALS, INC.: It had a hydroxyl value of 50 and a Tg of 50° C.)

Acrylonitrile-styrene resin . . . 28 parts by weight (Cebian N-080 (trade name) manufactured by DAICEL CHEMICAL INDUSTRIES, LTD.: It was prepared by polymerizing a mixture of monomers containing 30% acrylonitrile by weight.)

Polyester resin . . . 8 parts by weight (Biron 200 (trade name) manufactured by TOYOBO CO., LTD.: Its number-average molecular weight is 20,000.) Carboxyl-modified silicone oil . . . 2 parts by weight (X-22-162C (trade name) manufactured by Shin-Etsu Chemical Co., Ltd.)

Dimethyl silicone oil . . . 2 parts by weight (KF-96-500CS (trade name) manufactured by Shin-Etsu Chemical Co., Ltd.)

Talc . . . 15 parts by weight (5,000 PJ (trade name) manufactured by Matsumura Sangyo Co., Ltd.)

Polyisocyanate compound . . . 8 part by weight (Colonate L (trade name) manufactured by NIPPON POLYURETHANE INDUSTRY CO., LTD.)

Toluene and methyl ethyl ketone as solvents . . . 100 parts by weight (2) Evaluation of Thermal Transfer Recording Image Receiver of Example 4

A commercial three primary color ink sheet for the thermal transfer printer of the sublimation dye transfer type (Video Print Set VW-MPA50 (trade name) manufactured by Matsushita Electric Industrial Co., Ltd.) was used as the ink sheet.

Furthermore, when the first thermal transfer recording method of the image receiving layer transfer type (re-transferring type) was employed, a commercial white PET film (White PET Film U1 (trade name) manufactured by Teijin Limited) without having its surface treated was used as other (or final) substrate.

(a) Evaluation of the thermal transfer recording image receiver of Example 4 was carried out using the same manner as described in the evaluation of the thermal transfer recording image receivers of Examples 1–3, except that the thermal transfer recording image receiver of Example 4 was employed.

When the evaluation of the thermal transfer recording image receiver of Example 4 was carried out using the commercial thermal transfer printer of the sublimation dye transfer type, a glossy image was obtained, and a surface glossiness of the image receiving layer was substantially the same as that of the silver halide conventional photograph.

When the evaluation of the thermal transfer recording image receiver of Example 4 was carried out using the high speed business printer, a highly glossy image was obtained and no blocking between the image receiving layer of the thermal transfer recording image receiver of Example 4 and the dye layer of the ink sheet was observed. Moreover, qualities of the image was superior to those of the silver halide conventional photograph prepared using signals obtained by photographing the same object by employing the electronics still camera. Concretely, the high density region of the image increased by 15% in comparison with that of the silver halide conventional photograph.

Furthers a color difference ($\Delta E$) was less than 15 in the light resistance test, and the light resistance of the image was high.

(b) Evaluation using prototype printer of sublimation dye transfer type for thermal transfer recording method of first re-transferring type The evaluation of the thermal transfer recording image receiver of Example 4 was carried out by using the thermal transfer recording image receiver of Example 4 whose image receiving layer was releasable and the commercial ink sheet and also by employing the prototype printer of the sublimation dye transfer type which had both an image recording section wherein an image was recorded on the image receiving layer of the thermal transfer recording image receiver of Example 4 and an image transfer section wherein the image receiving layer having been recorded was transferred to a final substrate. After the image was formed on the image receiving layer at a rate of 5–10 mill-seconds/line in the image recording section of the printer, the image formed on the image receiving layer was transferred together with the image receiving layer onto the white PET film as the final substrate by heating the heat-resistant sliding layer on the back surface of the thermal transfer recording image receiver of Example 4 in the image transfer section in the printer using an image transfer head. The obtained image had a wide dynamic range and highly glossy. When the thermal transfer recording image receiver of Example 4 was used in the above prototype printer of the sublimation dye transfer type, a surface glossiness (positive reflection at 60°) of the recorded surface was 95-100 on the basis of the value of the silver halide conventional photograph (100), and was substantially the same as that of the silver halide conventional photograph.

When the thermal transfer recording image receiver of Example 4 is used, the image recording surface which has the recorded image thereon is able to be sealed inside from the exposed condition that the recorded image is on the surface of the image receiving layer. Therefore, it has been confirmed that the light stability and the finger touch stability of the image are highly improved and that the stability of the image is substantially near that of the silver halide conventional photograph.

Example 5

(1) Production of Thermal Transfer Recording Image Receiver of Example 5

A transparent smooth PET film having a thickness of 16 $\mu$m (a product of Toray Industries, Inc.) was employed as a substrate of the thermal transfer recording image receiver of Example 5.

(a) Preparation of Releasing Layer of Thermal Transfer Recording Image Receiver of Example 5

After mixing and stirring a material to be applied containing the following components, the material was applied on a front surface of the above substrate using the micro-gravure coater (#100). Drying the applied material for 96 hours at 45° C. gave a releasing layer.

Acrylic polyol resin . . . 85 parts by weight (Acrydic A-801 (trade name) manufactured by DAINIPPON INK AND CHEMICALS, INC.: It had a hydroxyl value of 50 and a Tg of 50° C.)

Silicone resin containing hydroxy group . . . 13 parts by weight (TSR-160 (trade name) manufactured by Toshiba Silicone Co., Ltd.: It contained 5% hydroxy group by weight.)

Higher fatty acid ester . . . 2 parts by weight (Exepal BS (trade name) manufactured by Kao Corporation)

Polyisocyanate compound . . . 35 part by weight (Colonate L (trade name) manufactured by NIPPON POLYURETHANE INDUSTRY CO., LTD.)

Toluene and methyl ethyl ketone as solvents . . . 100 parts by weight (b) Formation of Image Receiving Layer of Thermal Transfer Recording Image Receiver of Example 5

After mixing and stirring a material to be applied containing the same components as those of the material to be applied to form the image receiving layer of the thermal transfer recording image receiver of Example 3, the material was applied on the above releasing layer using the micro-gravure coater (#80) to form a coating having a thickness of 8 $\mu$m. Drying the applied material for 96 hours at 45° C. gave the image receiving layer.

(c) Formation of Heat-resistant Sliding Layer of Thermal Transfer Recording Image Receiver of Example 5

Furthermore, after mixing and stirring a material to be applied containing the following components, the material was applied on the back surface of the above substrate using the micro-gravure coater (#100) to form a coating having a thickness of 1 μm. Drying the applied material for 96 hours at 45° C. gave a heat-resistant sliding layer of the thermal transfer recording image receiver of Example 5. The thermal transfer recording image receiver of Example 5 corresponds to that of the embodiment shown in FIG. 5.

Acrylic resin containing amino group . . . 35 parts by weight (Acrydic BZ-1161 (trade name) manufactured by DAINIPPON INK AND CHEMICALS, INC.)

Silicone type curing agent . . . 16 parts by weight (Acrydic A-9585 (trade name) manufactured by DAINIPPON INK AND CHEMICALS, INC.)

Acrylonitrile-styrene resin . . . 15 parts by weight (Cebian N-080 (trade name) manufactured by DAICEL CHEMICAL INDUSTRIES, LTD.: It was prepared by polymerizing a mixture of monomers containing 30% acrylonitrile by weight.)

Silicone oil . . . 3 parts by weight (KF96 (trade name) manufactured by Shin-Etsu Chemical Co., Ltd.)

Solid slide agent (Talc) . . . 5 parts by weight (5,000 PJ (trade name) manufactured by Matsumura Sangyo Co., Ltd.)

Toluene and methyl ethyl ketone as solvents . . . 100 parts by weight (2) Evaluation of Thermal Transfer Recording Image Receiver of Example 5

Evaluation of the thermal transfer recording image receiver of Example 5 was carried out using the same manner as described in the evaluation of the thermal transfer recording image receiver of Example 4, except that the thermal transfer recording image receiver of Example 5 was employed instead of the thermal transfer recording image receiver of Example 4 and that commercial plain paper having its surface untreated was used as the final substrate.

When the evaluation of the thermal transfer recording image receiver of Example 5 was carried out using the commercial thermal transfer printer of the sublimation dye transfer type, an glossy image was obtained, and a surface glossiness of the image receiving layer was substantially the same as that of the silver halide conventional photograph.

When the evaluation of the thermal transfer recording image receiver of Example 5 was carried out using the high speed business printer, a highly glossy image was obtained and no blocking was observed. Moreover, qualities of the image was superior to those of the silver halide conventional photograph prepared using signals obtained by photographing the same object by employing the electronics still camera. A high density region of the image of Example 4 increased by 15% in comparison with that of the silver halide conventional photograph.

Furthermore, a color difference (ΔE) was less than 15 in the light resistance test, and the light resistance of the image was high.

When the evaluation was carried out using the prototype printer of the sublimation dye transfer type for the thermal transfer recording method of the first re-transferring type, the obtained image had a wide dynamic range and high glossiness. A surface glossiness was substantially the same as that of the silver halide conventional photograph.

When the thermal transfer recording image receiver of Example 5 is employed, the image is able to be obtained on plain paper, and is able to be formed in cheap. Furthermore, since the image receiving layer which has the recorded image is transferred, the recorded surface of the image receiving layer can be sealed inside from the exposed condition that the recorded image is on the surface of the image receiving layer. Therefore, the light stability and the finger touch stability of the image can be highly improved and the image having high glossiness and high grade can be obtained.

Example 6

(1) Production of Thermal Transfer Recording Image Receiver of Example 6

The thermal transfer recording image receiver of Example 6 was produced using the same manner as described in the production of the thermal transfer recording image receiver of Example 5 except that a transparent smooth PET film having a thickness of 12 μm (a product of Mitsubishi Polyester Co., Ltd.) was employed as the substrate of the thermal transfer recording image receiver of Example 6 instead of the PET film having a thickness of 16 μm, and that a releasing layer was formed by, in place of using the manner described in Example 5, using a material to be applied containing a silicone resin as a base, which material was applied on a front surface of the above substrate using a micro-gravure coater (#120) to form a layer having a thickness of 0.1–0.3 μm followed by drying 96 hours at 45° C.

(2) Evaluation of thermal transfer recording image receiver of Example 6

Evaluation of the thermal transfer recording image receiver of Example 6 was carried out using a prototype printer of the sublimation dye transfer type which is used for the thermal transfer recording method of the second re-transferring type at a rate of 5 milli-seconds per line. The printer had an image receiving layer transfer section in which the image receiving layer of the thermal transfer recording image receiver was transferred to the temporary support for the image receiving layer, an image recording section in which an image was recorded on thus transferred image receiving layer, and an image transfer section in which thus recorded image receiving layer was transferred to a final substrate as shown in FIG. 7.

In the image receiving layer transfer section of the prototype printer which is used for thermal transfer recording method of the re-transferring type, an arbitrarily shaped image receiving layer was transferred to the temporary support for the image receiving layer which was made of a polyimide film having a thickness of about 25 μm (Captone 100EN (trade name) manufactured by Toray-Du Pont Co., Ltd.) by heating the image receiving layer using a heating head (an image receiving layer transfer head) from the back side of the thermal transfer recording image receiver of Example 6. In the image recording section, thus transferred image receiving layer was contacted with an ink sheet for the commercial printer of the sublimation dye transfer type and an image was recorded on the image receiving layer by heating the back side of the ink sheet using a heating head (a image recording head). In the image transfer section, the recorded image receiving layer was contacted with plain paper as the final substrate and the image formed on the image receiving layer was transferred together with the image receiving layer on the temporary support for the image receiving layer to the plain paper as the final substrate.

The obtained. image had a saturated density of 2.7–2.9 of, a wide dynamic range, and high glossiness. When the thermal transfer recording image receiver of Example 6 was used in the above prototype printer of the sublimation dye transfer type, a surface glossiness (positive reflection at 60°) of the recorded surface was not less than 100 on the basis of the value (100) of the silver halide conventional photograph, and such glossiness was substantially equivalent to or not inferior to that of the silver halide conventional photograph.

When the thermal transfer recording image receiver of Example 6 is employed, the image is able to be formed on plain paper and in cheap. Furthermore, since the image receiving layer having the recorded image is transferred, the recorded surface of the image receiving layer is able to be sealed inside from a condition of the exposed surface of the image receiving layer. Therefore, the light stability and the finger touch stability of the image are highly improved and the image having the high glossiness and the high grade is obtained.

What is claimed is:

1. An image receiving layer (B) used for a thermal transfer recording image receiver comprising a substrate (A) and the image receiving layer (B) which is formed on the front surface oft he substrate (A) wherein the image receiving layer (B) is formed from a composition comprising an acrylic polyol resin, other thermoplastic resin and a higher fatty acid ester and/or a derivative thereof and wherein the composition comprising the acrylic polyol resin and said other thermoplastic resin and the higher fatty acid ester and/or derivative thereof to form the image receiving layer (B) is homogeneous.

2. The image receiving layer according to claim 1 wherein the acrylic polyol resin has a hydroxyl value of not less than 30.

3. The image receiving layer according to claim 1 wherein said other thermoplastic resin is at least one selected from a polyester resin, a vinyl chloride-vinyl acetate copolymer resin, and a silicone resin.

4. The image receiving layer according to claim 3 wherein the polyester resin has a number average molecular weight of not more than 15,000.

5. The image receiving layer according to claim 3 wherein the polyester resin has a hydroxyl value of not less than 30.

6. The image receiving layer according to claim 3 wherein the polyester resin has a bisphenol A skeleton.

7. The image receiving layer according to claim 3 wherein the polyester resin is a polycaprolactonediol.

8. The image receiving layer according to claim 3 wherein a content of moieties derived from vinyl chloride in the vinyl chloride-vinyl acetate copolymer resin is 75 to 85% by weight and the vinyl chloride-vinyl acetate copolymer resin is modified with a hydroxyl group at its end.

9. The image receiving layer according to claim 3 wherein the silicone resin is an alkyd-modified, polyester-modified, or acryl-modified silicone resin.

10. The image receiving layer according to claim 1 wherein any said other thermoplastic resin has a hydroxy group.

11. The image receiving layer according to claim 1 wherein the composition to form the receiving layer (B) has been cross-linked with a crosslinking agent.

12. The image receiving layer according to claim 11 wherein the crosslinking agent is a polyisocyanate compound.

13. The image receiving layer according to claim 1 wherein the composition to form the image receiving layer (B) comprises a benzotriazole compound as an ultraviolet absorber.

14. The image receiving layer according to claim 1 wherein the composition to form the image receiving layer (B) further comprises a higher fatty acid-modified silicone oil.

15. A thermal transfer recording image receiver comprising both of the substrate (A) and the image receiving layer (B) according to claim 1.

16. The thermal transfer recording image receiver according to claim 15 wherein the image receiving layer (B) is releasable from the substrate (A).

17. The thermal transfer recording image receiver according to claim 16 which has a releasing layer (C) between the substrate (A) and the image receiving layer (B), and wherein the image receiving layer (B) is releasable at an interface between the image receiving layer (B) and the releasing layer (C).

18. The thermal transfer recording image receiver according to claim 17 wherein the releasing layer (C) is formed from a composition comprising an acrylic polyol resin.

19. The thermal transfer recording image receiver according to claim 18 wherein the acrylic polyol resin has a hydroxyl value of not less than 30.

20. The thermal transfer recording image receiver according to claim 17 wherein the releasing layer (C) is formed from the composition comprising a silicone resin.

21. The thermal transfer recording image receiver according to claim 17 wherein in the releasing layer (C), the composition to form the releasing layer (C) has been cross-linked.

22. The thermal transfer recording image receiver according to claim 17 wherein each oft he image receiving layer (B) and the releasing layer (C) have a composition grading area in the vicinity of an interface between the layers (B) and (C).

23. The thermal transfer recording image receiver according to claim 15 wherein the substrate (A) comprises a heat-resistant sliding layer on a back surface of the substrate (A).

24. A thermal transfer recording method in which the thermal transfer recording image receiver according to claim 15 is used wherein a back surface of an ink sheet is heated by a heating means to transfer a thermally transferable dye from a dye layer of the ink sheet to the image receiving layer of the thermal transfer recording image receiver, so that an image is formed the image receiving layer.

25. A thermal transfer recording method in which the thermal transfer recording image receiver according to claim 15 used, wherein a back surface of an ink sheet is heated by a heating means to transfer a thermally transferable dye from a dye layer of the ink sheet to the image receiving layer of the thermal transfer recording image receiver, so that an image is formed on the image receiving layer, and then the image receiving layer on which the image has been formed is transferred to other substrate.

26. A thermal transfer recording method in which the thermal transfer recording image receiver according to claim 15 is used, wherein the image receiving layer in the thermal transfer recording image receiver is transferred to a temporary support for the image receiving layer, a back surface of an ink sheet is then heated by a heating means to transfer a thermally transferable dye from a dye layer of the ink sheet to the image receiving layer which has been transferred to the temporary support for the image receiving layer, so that an image is formed on the image receiving layer, and then the image receiving layer on which the image has been formed is transferred to other substrate.

27. A thermal tansfer recording apparatus for the thermal transfer recording method according to claim 15, in which the thermal transfer recording image receiver comprising a substrate (A) and the image receiving layer (B) wherein the image receiving layer (B) is formed from a composition comprising an acrylic polyol resin and other thermoplastic resin and wherein the composition comprising the acrylic polyol resin and said other thermoplastic resin to form the image receiving layer (B) is homogeneous, is used.

28. An image receiving layer (B) used for a thermal transfer recording image receiver comprising a substrate (A) and the image receiving layer (B) which is formed on the front surface of the substrate (A) wherein the image receiving layer (B) is formed from a composition comprising an acrylic polyol resin, other thermoplastic resin and a higher fatty acid-modified silicone oil and wherein the composition comprising the acrylic polyol resin, said other thermoplastic resin and the higher fatty acid-modified silicone oil to form the image receiving layer (B) is homogeneous.

29. The image receiving layer according to claim 28 wherein the acrylic polyol resin has a hydroxyl value of not less than 30.

30. The image receiving layer according to claim 28 wherein said other thermoplastic resin is at least one selected from a polyester resin, a vinyl chloride-vinyl acetate copolymer resin, and a silicone resin.

31. The image receiving layer according to claim 30 wherein the polyester resin has a number average molecular weight of not more than 15,000.

32. The image receiving layer according to claim 30 wherein the polyester resin has a hydroxyl value of not less than 30.

33. The image receiving layer according to claim 30 wherein the polyester resin has a bisphenol A skeleton.

34. The image receiving layer according to claim 30 wherein the polyester resin is a polycaprolactonediol.

35. The image receiving layer according to claim 30 wherein a content of moieties derived from vinyl chloride in the vinyl chloride-vinyl acetate copolymer resin is 75 to 85% by weight and the vinyl chloride-vinyl acetate copolymer resin is modified with a hydroxyl group at its end.

36. The image receiving layer according to claim 30 wherein the silicone resin is an alkyd-modified, polyester-modified, or acryl-modified silicone resin.

37. The image receiving layer according to claim 28 wherein any said other thermoplastic resin has a hydroxy group.

38. The image receiving layer according to claim 28 herein the composition to form the receiving layer (B) has been cross-linked with a crosslinking agent.

39. The image receiving layer according to claim 38 wherein the crosslinking agent is a polyisocyanate compound.

40. The image receiving layer according to claim 28 wherein the composition to form the image receiving layer (B) comprises a benzotriazole compound as an ultraviolet absorber.

41. A thermal transfer recording image receiver comprising both the substrate (A) and the image receiving layer (B) according to claim 28.

42. The thermal transfer recording image receiver according to claim 41 wherein the image receiving layer (B) is releasable from the substrate (A).

43. The thermal transfer recording image receiver according to claim 42 which has a releasing layer (C) between the substrate (A) and the image receiving layer (B), and wherein the image receiving layer (B) is releasable at an interface between the image receiving layer (B) and the releasing layer (C).

44. The thermal transfer recording image receiver according to claim 43 wherein the releasing layer (C) is formed from a composition comprising an acrylic polyol resin.

45. The thermal transfer recording image receiver according to claim 44 wherein the acrylic polyol resin has a hydroxyl value of not less than 30.

46. The thermal transfer recording image receiver according to claim 43 wherein the releasing layer (C) is formed from the composition comprising a silicone resin.

47. The thermal transfer recording image receiver according to claim 43 wherein in the releasing layer (C), the composition to form the releasing layer (C) has been cross-linked.

48. The thermal transfer recording image receiver according to claim 43 wherein each of the image receiving layer (B) and the releasing layer (C) have a composition grading area in the vicinity of an interface between the layers (B) and (C).

49. The thermal transfer recording image receiver according to claim 41 wherein the substrate (A) comprises a heat-resistant sliding layer on a back surface of the substrate (A).

50. A process of producing the thermal transfer recording image receiver according to claim 41 which is produced by adding a solvent capable of solving the composition for forming the image receiving layer (B) which is formed from a homogeneous composition comprising an acrylic polyol resin and other thermoplastic resin and applying the resultant solution onto a front surface of the substrate (A) then followed by drying the applied material.

51. A thermal transfer recording method in which the thermal transfer recording image receiver according to claim 41 used wherein a back surface of an ink sheet is heated by a heating means to transfer a thermally transferable dye from a dye layer of the ink sheet to the image receiving layer of the thermal transfer recording image receiver, so that an image is formed on the image receiving layer.

52. A thermal transfer recording method in which the thermal transfer recording image receiver according to claim 41 is used, wherein a back surface of an ink sheet is heated by a heating means to transfer a thermally transferable dye from a dye layer of the ink sheet to the image receiving layer of the thermal transfer recording image receiver, so that an image is formed on the image receiving layer, and then the image receiving layer on which the image has been formed is transferred to other substrate.

53. A thermal transfer recording method in which the thermal transfer recording image receiver according to claim 41 is used, wherein the image receiving layer in the thermal transfer recording image receiver is transferred to a temporary support for the image receiving layer, a back surface of an ink sheet is then heated by a heating means to transfer a thermally transferable dye from a dye layer of the ink sheet to the image receiving layer which has been transferred to the temporary support for the image receiving layer, so that an image is formed on the image receiving layer, and then the image receiving layer on which the image has been formed is transferred to other substrate.

54. A thermal transfer recording apparatus for the thermal transfer recording method according to claim 41, in which the thermal transfer recording image receiver comprising a substrate (A) and the image receiving layer (B) wherein the image receiving layer (B) is formed from a composition comprising an acrylic polyol resin and other thermoplastic resin and wherein the composition comprising the acrylic polyol resin and said other thermoplastic resin to form the image receiving layer (B) is homogeneous, is used.

* * * * *